US009303426B2

(12) United States Patent
Workman et al.

(10) Patent No.: US 9,303,426 B2
(45) Date of Patent: Apr. 5, 2016

(54) MODULAR FRAME AND STRUCTURE SYSTEM

(71) Applicant: Bare Bones Systems LLC., Morgan, UT (US)

(72) Inventors: Tyler Swan Workman, Morgan, UT (US); Robert E. Workman, Morgan, UT (US); Henry J. Howell, Herriman, UT (US); Norm Krantz, Logan, UT (US); Gerardo D. Ayala, Provo, UT (US); John E. Workman, Provo, UT (US)

(73) Assignee: BARE BONES SYSTEMS LLC, Bluffdale, UT (US)

( * ) Notice: Subject to any disclaimer, the term of this patent is extended or adjusted under 35 U.S.C. 154(b) by 0 days.

(21) Appl. No.: 13/782,654

(22) Filed: Mar. 1, 2013

(65) Prior Publication Data

US 2013/0276382 A1 Oct. 24, 2013

Related U.S. Application Data

(60) Provisional application No. 61/606,172, filed on Mar. 2, 2012.

(51) Int. Cl.

| | |
|---|---|
| ***E04H 15/44*** | (2006.01) |
| ***E04H 15/18*** | (2006.01) |
| ***E04H 15/32*** | (2006.01) |
| ***E04H 15/34*** | (2006.01) |
| ***E04H 15/56*** | (2006.01) |
| *E04H 15/00* | (2006.01) |
| *E04H 15/14* | (2006.01) |

(52) U.S. Cl.

CPC ..... *E04H 15/44* (2013.01); *E04H 15/18* (2013.01); *E04H 15/32* (2013.01); *E04H 15/34* (2013.01); *E04H 15/008* (2013.01); *E04H 15/14* (2013.01); *E04H 15/56* (2013.01)

(58) Field of Classification Search

CPC ..... E04H 15/14; E04H 15/18; E04H 15/008; E04H 15/32; E04H 15/34; E04H 15/44; E04H 15/56

USPC ..... 52/79.5, 653.1, 2.25; 135/87, 97, 95, 135/121, 143–144, 151, 157–158, 160, 135/114–115, 117; 403/170–171, 176, 181, 403/217–218, 305, 296, 311

See application file for complete search history.

(56) References Cited

U.S. PATENT DOCUMENTS 2,168,913 A * 8/1939 Middleton ..... 135/157
2,719,384 A 10/1955 Eames (Continued)

*Primary Examiner* — Jeanette E Chapman

(74) *Attorney, Agent, or Firm* — Morriss O'Bryant Compagni, PC

(57) ABSTRACT

A modular frame and structure system and method includes a framework and a cover coupled to the framework and configured to provide a desired structure. The framework includes a plurality of elongated frame members, and a plurality of coupling members for coupling the elongated frame members. One or more of the coupling members includes a releasable connecting device having a connecting mode for connecting the coupling members to the frame members and form the framework, the releasable connecting device having a release mode for disconnecting the elongated frame members from the coupling members. The cover includes one or more interlocking wall panels configured to engage and be supported by the elongated frame members, and one or more interlocking roof panels configured to engage and be supported by the elongated frame members.

18 Claims, 37 Drawing Sheets

(56) References Cited

U.S. PATENT DOCUMENTS

| | | | | | |
|---|---|---|---|---|---|
| 3,441,037 | A | * | 4/1969 | Transeau | 135/97 |
| 3,773,061 | A | | 11/1973 | Berger | |
| 3,807,421 | A | | 4/1974 | Geiger et al. | |
| 3,877,824 | A | * | 4/1975 | Jury | 403/174 |
| 3,886,961 | A | | 6/1975 | Geiger et al. | |
| 3,974,600 | A | | 8/1976 | Pearce | |
| 4,066,089 | A | * | 1/1978 | Rainwater | 135/151 |
| 4,129,975 | A | | 12/1978 | Gabriel | |
| 4,193,413 | A | * | 3/1980 | Watts et al. | 135/98 |
| 4,446,666 | A | | 5/1984 | Gilman | |
| 4,603,853 | A | | 8/1986 | Satterthwaite | |
| 4,882,884 | A | | 11/1989 | Browne | |
| 5,000,211 | A | | 3/1991 | Speare et al. | |
| 5,056,291 | A | | 10/1991 | Leung | |
| 5,078,096 | A | * | 1/1992 | Bishop et al. | 119/497 |
| 5,230,196 | A | | 7/1993 | Zeigler | |
| 5,274,980 | A | | 1/1994 | Zeigler | |
| 5,293,725 | A | * | 3/1994 | Matticks et al. | 52/271 |
| 5,335,618 | A | * | 8/1994 | Zarola | 119/498 |
| 5,390,689 | A | * | 2/1995 | Graillat | 135/126 |
| 5,598,668 | A | | 2/1997 | Isom | |
| 5,671,766 | A | * | 9/1997 | Williams | 135/121 |
| 5,790,992 | A | * | 8/1998 | Ray | 4/599 |
| 6,345,638 | B1 | | 2/2002 | Warner | |
| 6,578,593 | B2 | | 6/2003 | Leonarz | |
| 6,708,455 | B1 | | 3/2004 | Niiduma | |
| 6,766,623 | B1 | | 7/2004 | Kalnay | |
| 6,832,455 | B1 | | 12/2004 | Tomlinson et al. | |
| 6,871,452 | B2 | | 3/2005 | Berg | |
| 7,341,391 | B2 | * | 3/2008 | Nakahori et al. | 403/27 |
| 7,448,400 | B2 | | 11/2008 | Jensen | |
| 2007/0039247 | A1 | * | 2/2007 | Greenfeld et al. | 52/2.25 |
| 2009/0038237 | A1 | | 2/2009 | Jensen | |

* cited by examiner

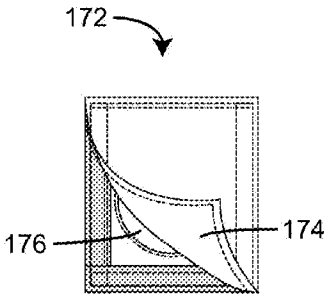
FIGURE 6B
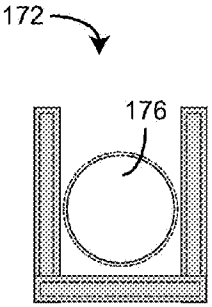
FIGURE 6C
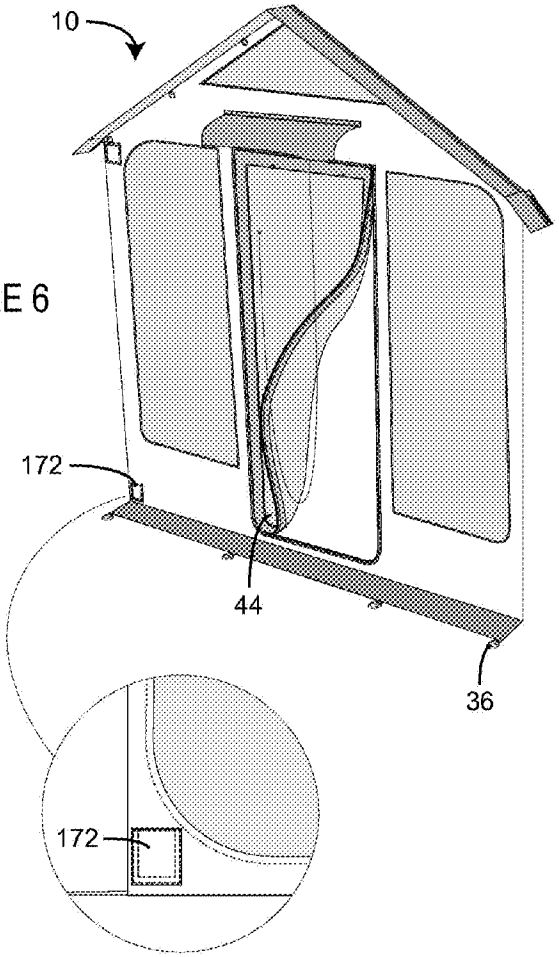
FIGURE 6
FIGURE 6A

MODULAR FRAME AND STRUCTURE SYSTEM

CROSS-REFERENCE TO RELATED APPLICATIONS

This application claims the benefit of priority to U.S. Provisional Patent Application No. 61/606,172, which was filed on Mar. 2, 2012, the complete disclosure of which is incorporated by reference herein.

FIELD

The present disclosure relates generally to the field of modular frame and structure systems and methods for assembling or installing such frames and/or structures. More specifically, the present disclosure relates to modular frame and structure systems and methods having elongated frame members (e.g. poles, etc.) that may come in a variety of standard lengths, and a variety of interconnecting coupling members (e.g. hardware, joints, hubs, spiders, feet, connectors, clips, couplers, links, extenders, hooks, etc.) for interconnecting with the poles and other components so that the poles can be erected into any of a variety of standardized (or customized) framework configurations. Once assembled, the framework provides a structure that may support a soft or hard covering, such as to provide a readily transportable and quickly-assembled shelter or dwelling. Still more particularly, the present disclosure relates to modular frame and structure systems and methods having a variety of interconnecting coupling members that are substantially releasable in-situ so that the framework, once assembled, can be readily modified or reconfigured without disassembling other portions of the framework.

BACKGROUND

This section is intended to provide a background or context to the subject matter. The description herein may include concepts that could be pursued, but are not necessarily ones that have been previously conceived or pursued. Therefore, unless otherwise indicated herein, what is described in this section is not prior art to the description in this application and is not admitted to be prior art by inclusion in this section.

It is generally known to provide removably-connectable and transportable poles and connectors for constructing frames, such as tent frames, space frames and the like. However, the conventional systems and methods for assembling such frames typically include connectors that are not readily adaptable or reconfigurable in-situ for modifying or changing the framework after initial assembly.

Accordingly, it would be desirable to provide one or more modular frame and structure systems and methods that overcomes these and other disadvantages.

SUMMARY

An embodiment of the disclosure relates to a modular frame and structure system. The modular frame and structure system includes a framework and a cover coupled to the framework and configured to provide a desired structure. The framework includes a plurality of elongated frame members, and a plurality of coupling members for coupling the elongated frame members. One or more of the coupling members includes a releasable connecting device having a connecting mode for connecting the coupling members to the frame members and form the framework, the releasable connecting device having a release mode for disconnecting the elongated frame members from the coupling members.

In this embodiment, the cover includes one or more interlocking wall panels configured to engage and be supported by the elongated frame members, and one or more interlocking roof panels configured to engage and be supported by the elongated frame members.

Another embodiment of the present disclosure relates to a framework for a modular frame and structure system. The framework includes a plurality of elongated frame members, and a plurality of coupling members for coupling the elongated frame members. One or more of the coupling members includes a releasable connecting device having a connecting mode for connecting the coupling members to the elongated frame members and form the framework, the releasable connecting device having a release mode for disconnecting the elongated frame members from the coupling members.

Another embodiment of the present disclosure relates to a cover for a modular frame and structure system. The cover includes one or more interlocking wall panels configured to engage and be supported by one or more elongated frame members, forming a wall surface, one or more interlocking roof panels configured to engage and be supported by one or more elongated frame members, forming a roof surface, and one or more interlocking floor panels configured to engage and be supported by one or more elongated frame members, forming a floor surface.

BRIEF DESCRIPTION OF THE DRAWINGS

The disclosure will become more fully understood from the following detailed description, taken in conjunction with the accompanying figures, in which:

FIG. 6 is a perspective view of the front side of the enclosure of FIG. 2.

FIG. 6A is a close-up view of a portion of the front side of FIG. 6, including a hose port having a covering flap in a closed position.

FIG. 6B is a close-up view of the hose port of FIG. 6A with the flap in a partially open position.

FIG. 6C is a close-up view of the hose port of FIG. 6A with the flap in the open position.

DETAILED DESCRIPTION

Referring to the FIGURES, a modular frame and structure system is shown according to various exemplary embodiments. The system is shown to include elongated frame members of varying lengths and a variety of coupling members that quickly and securely connect to one or more of the frame members to create a framework, and a variety of covers (e.g. skins, etc., such as soft/flexible, hard/rigid, mesh, transparent, etc.) for use in customizing the framework into a particularly desired structure. According to any of the illustrated embodiments, the system is intended to provide a readily-transported, quickly-assembled and easily-reconfigurable modular structure that can be rapidly deployed to provide a quick structural solution as a shelter, dwelling, enclosure or the like to support any of a wide variety of activities such as (but not limited to) base camps, outposts, aid stations, disaster relief, military operations, receptions, command and control operations, kennels, livestock management (e.g. chicken coops, etc.), gardening and agriculture (e.g. greenhouses, etc.), sporting events, recreation events, commercial activities such as farmers markets, etc.

Figure 1A:
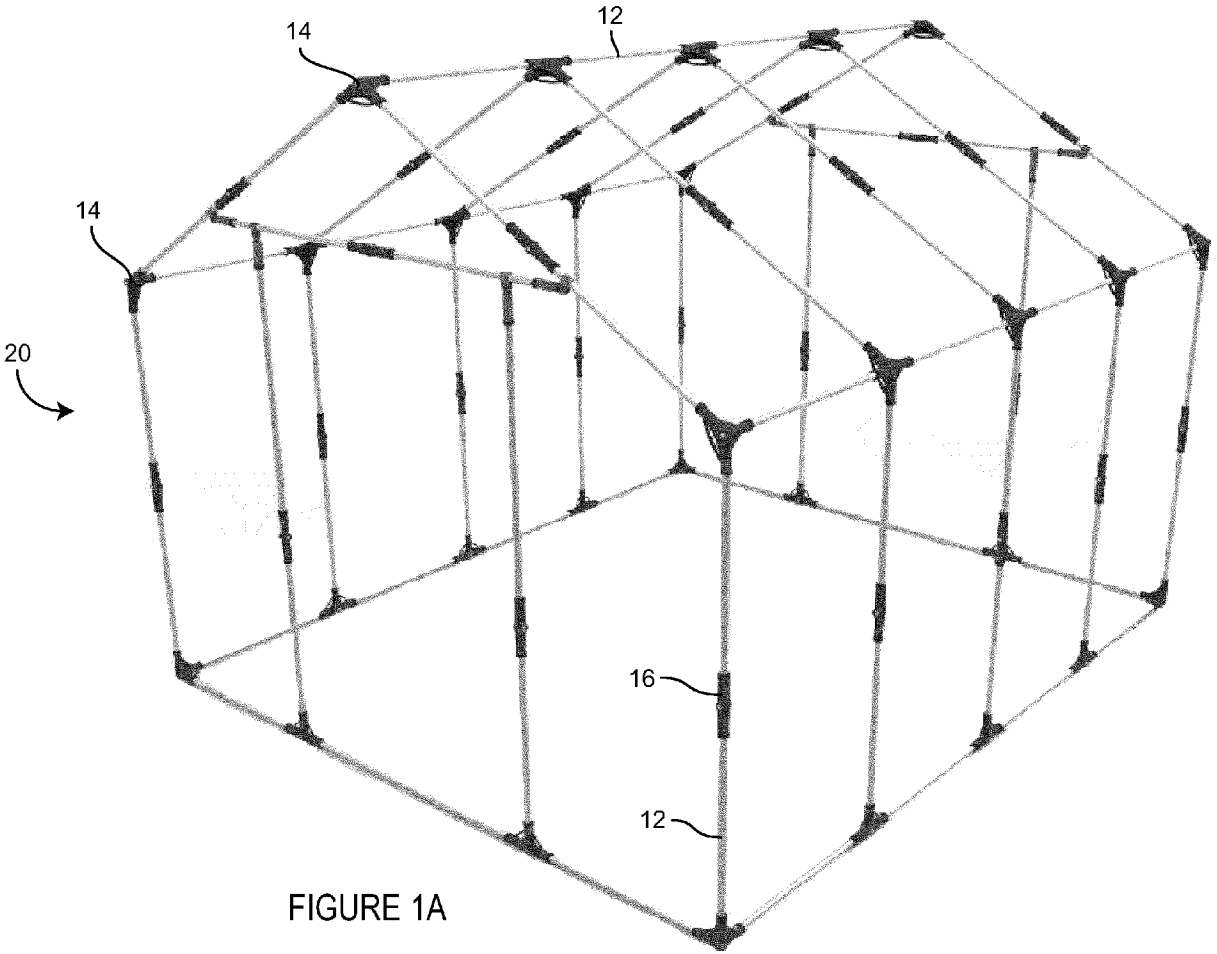
FIG. 1A is a perspective view of a modular frame structure according to the exemplary systems and methods described herein.
Figure 1B:
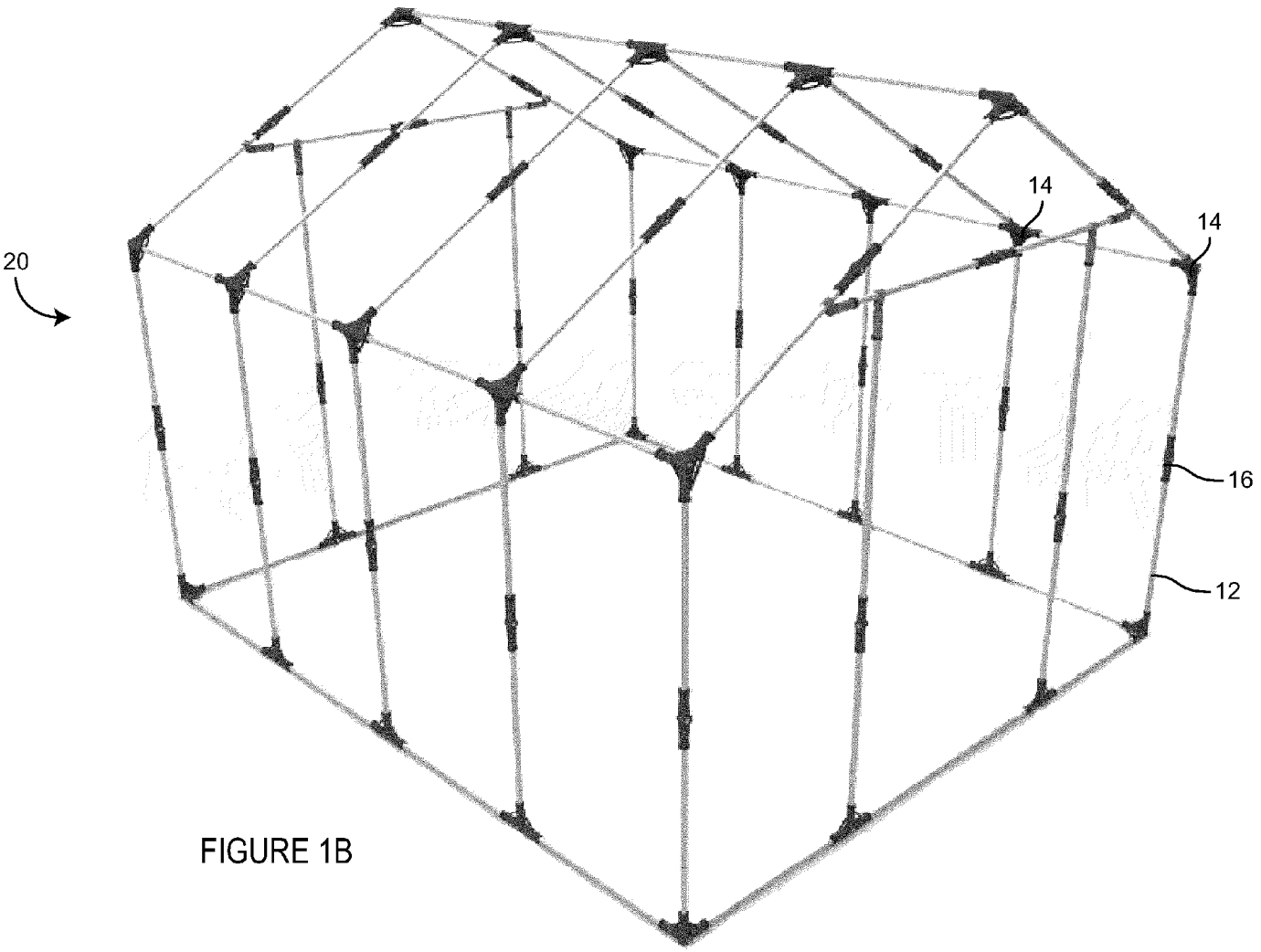
FIG. 1B is another perspective view of the modular frame structure of FIG. 1A.

Referring to FIGS. 1A-B, a framework for a modular frame and structure system 10 (shown in FIG. 2) is shown according to an exemplary embodiment. The modular frame and structure system 10 includes a framework shown as framework 20, including elongated frame members 12 (e.g. poles, etc.) of varying lengths and a variety of coupling members or connectors 14 and in-line couplers 16 that quickly and securely connect to one or more of the frame members 12 to create the framework 20. The connectors 14 include releasable connecting devices (not shown) so that the connectors 14 can be removed and/or reinstalled on an existing framework 20 substantially in-situ without having to significantly disassemble the framework 20, so that modifications or adaptations of the framework 20 may be quickly and easily accommodated. In other embodiments, the framework 20 can have another configuration of frame members 12, connectors 14, and couplers 16 that is suited for the particular application.

Referring still to FIGS. 1A-B, the elongated frame members 12 (e.g., tubes, pipes, poles, etc.) are joined together with a variety of coupling devices or connectors 14 to create various framework geometries and configurations. According to an exemplary embodiment, the frame member 12 is a hollow, cylindrical member configured to provide suitable rigidity and strength to the framework 20 to allow the framework 20 to be a freestanding structure that does not deform excessively (e.g., bend, sag, twist, etc.) due to dead loads (e.g., the weight of the framework 20, the weight of the covers, etc.), contact from persons utilizing the system 10, or live loads such as environmental loads (e.g., snow, leaves, wind, etc.). The frame members 12 are preferably relatively lightweight to facilitate the transport and erection of the frame and structure system 10. According to exemplary embodiments, the frame members 12 are formed of aluminum. In other embodiments, the frame members 12 may be formed of another metal or alloy. In still other embodiments, the frame members 12 may be formed of a polymer (e.g., a thermoplastic thermoset plastic, etc.) or a composite material. Likewise, the connectors 14 may be formed of any material (e.g., metal, alloy, polymer, composite, nylon, etc.) that provides a sufficient rigidity and strength and is able to withstand bending moments applied to the connectors 14 by the frame members 12.

The frame members 12 may be provided in a variety of lengths. In one embodiment, the frame members 12 may be provided in a limited number of standardized lengths to reduce confusion during assembly of the frame and structure system 10. In some embodiments, several frame members 12 may be aligned and coupled together utilizing in-line couplers 16 to create longer lengths. The coupler 16 is shown as a tubular member with ends configured to receive the ends of the frame members 12. The ends of the frame members 12 may be chamfered or tapered to facilitate the insertion of the frame members 12 into the couplers 16. The ends of the frame members 12 and the couplers 16 include features to lock the frame members 12 and the couplers 16 together.

Figure 2:
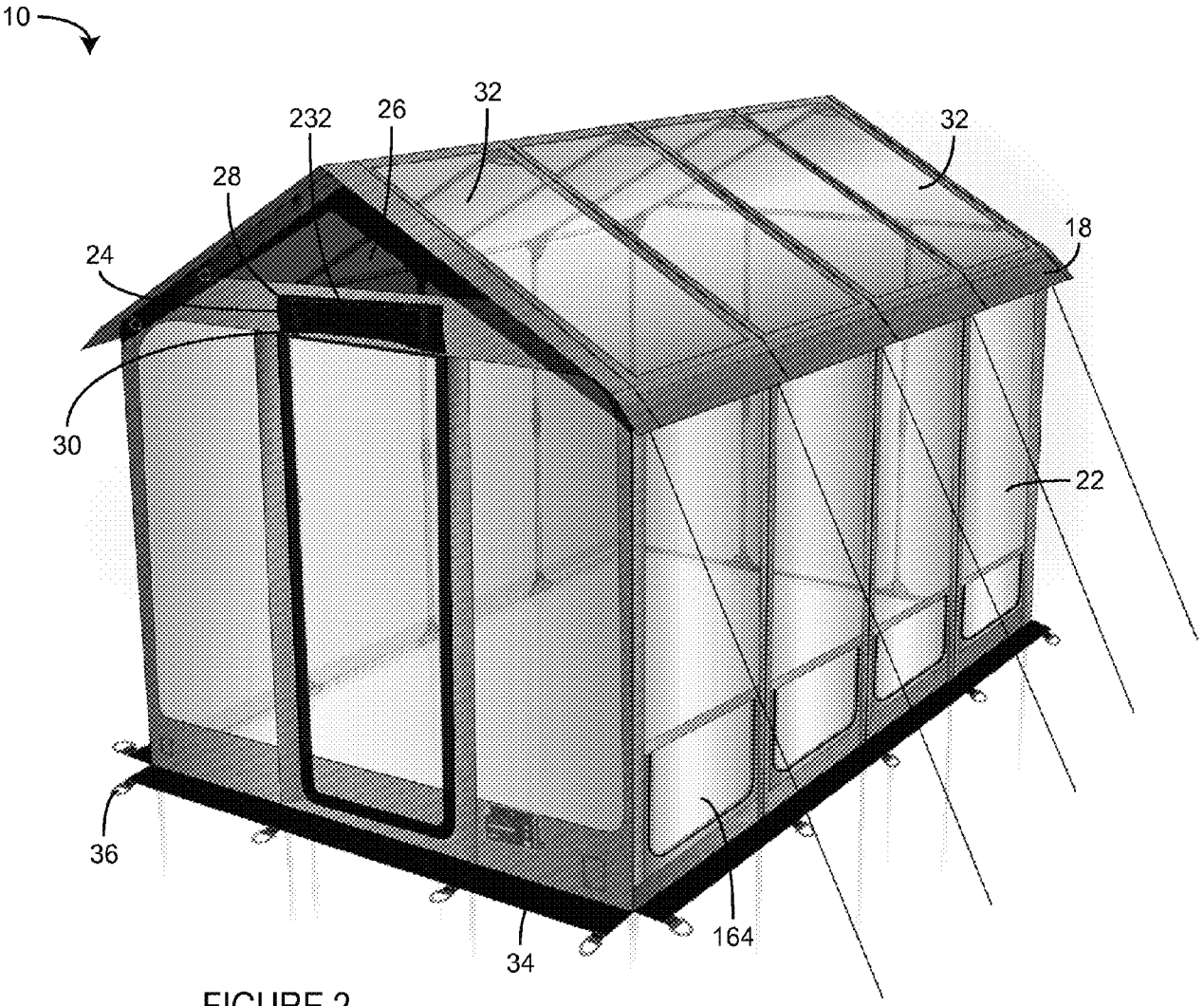
FIG. 2 is a perspective view of an enclosure utilizing the modular frame structure of FIG. 1A, according to an exemplary embodiment.
Figure 4:
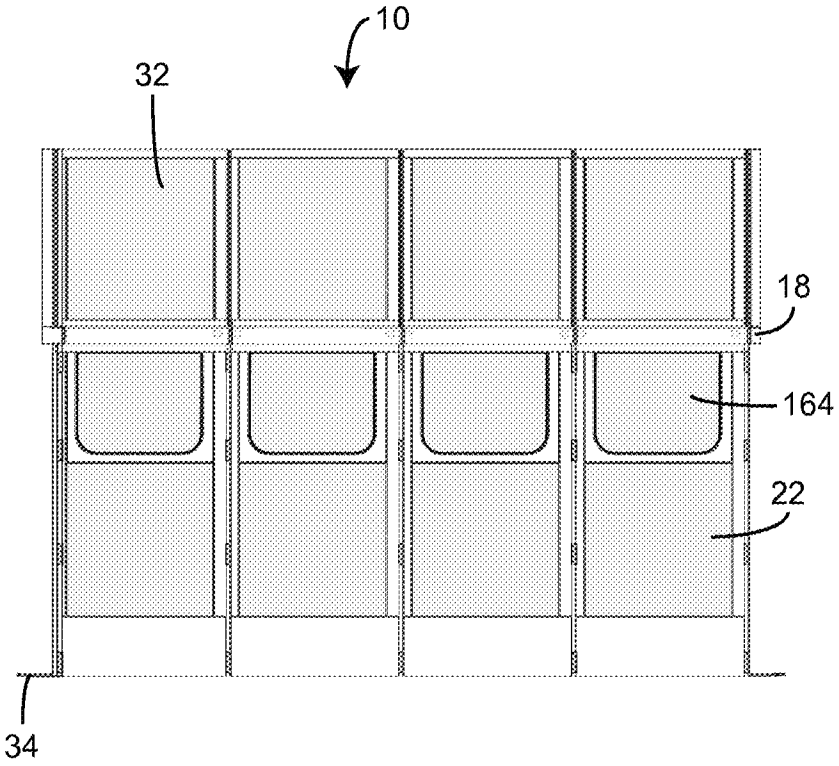
FIG. 4 is another side view of the enclosure of FIG. 2.
Figure 3:
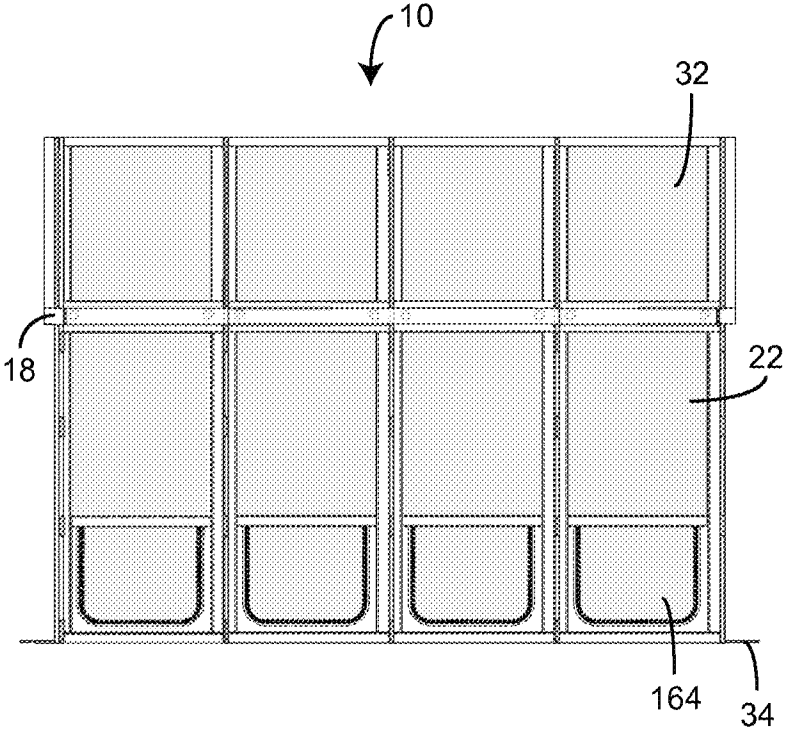
FIG. 3 is a side view of the enclosure of FIG. 2.

Referring to FIGS. 2-4, the system 10 further includes a variety of covers 18 (e.g. skins, etc., such as soft/flexible, hard/rigid, mesh, transparent, etc.) for use in customizing the framework 20 into a particular desired structure. The covers 18 may include any of a variety of materials having desired functional and aesthetic characteristics to suit an intended application. The covers 18 may be waterproof and insulated, may include openings such as windows or vents for climate control, and may include passageways such as doors. The covers 18 may also include solar absorptive or reflective materials as needed. The covers 18 may also be adapted to include (or to be useable with) a rainwater collection system and/or a solar energy collection system (e.g. photovoltaic panels, solar thermal collectors, etc.). The covers 18 may also comprise a relatively soft or flexible material, or a stronger and more rigid material, or a mesh material, or any combination thereof. The covers 18 may be opaque or transparent (or a combination thereof), and may form any one or more of a roof portion, side portions, floor portions or interior partitions. For example, one or more interlocking floor panels 34 (e.g. planks, etc.) may be included that are configured to engage and be supported by the elongated members 12 to provide a floor surface.

Referring still to FIGS. 2-4, the system 10 further includes other cover configurations for use with the framework 20 to provide a customized structure. Wall panels 22 may include a mesh or screen material, and selectively deployable flaps 24 may be provided to cover the mesh portion of the wall panels 22 when the flaps 24 are in the deployed position. Mesh or screen panels or windows may also be used as vents, such as vent 26 located beneath a peak of roof panel 32. According to the embodiment of FIG. 2, the flaps 24 may be configured to roll-up into a storage position generally above their associated mesh or screen wall panel 22. The flaps 24 may be held in the storage position under flap covers 232 and may be secured by suitable straps 28 having quick-release latches or closures 30. The system 10 may also include windows 164 located at the bottom or top of the wall panels 22.

Roof panels 32 may be provided on the roof portion of the structure system 10. In some embodiments, the roof panels 32 are clear or substantially clear or transparent to facilitate collection of solar energy (e.g. in the manner of a greenhouse or the like). In these embodiments, the system 10 may be configured to provide a "cold greenhouse," used to protect plant life from adverse weather, such as excessive cold and/or wet. Roof panels 32 may be formed from a clear poly material or similar material having a protective polyurethane coating. These transparent roof panels 32 admit sunlight and prevent heat escape via convection that would otherwise occur, particularly at night.

The system 10 may further include a floor panel 34 made from a substantially waterproof, flexible and durable material that is cleanable. Anchoring devices (shown for example as D-rings 36 or the like) may be provided on the floor panels 34 and/or wall panels 22 to facilitate securing the structure system 10 to the ground (e.g. with stakes and/or tie-downs, etc.).

Referring further to FIGS. 3 and 4, side views of the modular frame and structure system 10 are shown, according to an exemplary embodiment. A first side of the system 10, shown in FIG. 3, may include windows 164 on the bottom of the wall panels 22. A second side of the system 10, shown in FIG. 4, may include windows 164 on the top of the wall panels 22. The windows 164 are configured to open and close in order to circulate air within the system 10. The windows 164 may include zippers or other attachment components for opening or closing the windows 164. In exemplary embodiments, the windows 164 are made from a clear material configured to receive sunlight into the system 10. The windows 164 are shown more particularly in FIG. 5.

Figures 5, 5A, 5B:
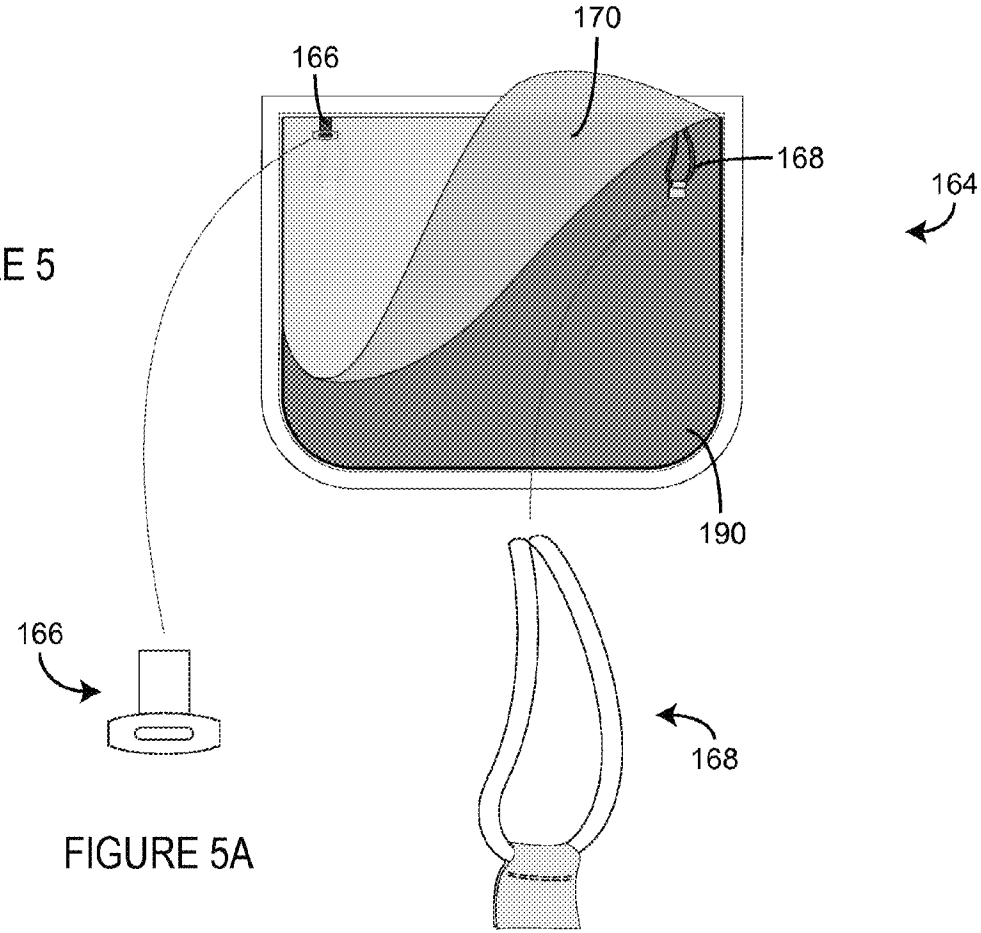
FIG. 5 is an isolated view of a window for the enclosure of FIG. 2.
FIG. 5A is a toggle for the window of FIG. 5.
FIG. 5B is a lanyard for the window of FIG. 5.

Referring to FIG. 5, the window 164 is shown to include a flap 170 that opens to allow air into the system 10. The flap 170 may be made from a clear material intended to admit sunlight into the system 10 and prevent heat from escaping the system 10. The flap 170 is configured to open, revealing a vent 190 positioned underneath the flap 170. The vent 190 may be made from a mesh material and may be configured to allow air into the system 10 while also keeping out insects or debris. The window 164 may also include a toggle 166 and an elastic cord 168 (shown in further detail in FIGS. 5A and 5B, respectively). In order to open the window 164 and allow air to enter the system 10, the flap 170 is rolled up above the window 164. The elastic cord 168 is configured to stretch across the window 164, over the flap 170, and connect to the toggle 166, holding the flap 170 in the open position. In exemplary embodiments, the elastic cord 168 is made from an elastic material and is configured to stretch across the length of the window 164. The toggle 166 is formed and sized to be received by the elastic cord 168.

Referring to FIGS. 6-6C, the system 10 may include a port (e.g. port hole, hose port, tubing port, etc.) shown as hose port 172. The hose port 172 is configured to receive a hose for introducing a fluid into the system 10. For instance, the hose port 172 may receive a hose configured to introduce water for watering plant life, agriculture or livestock, etc. within the system 10. The hose port 172 includes a flap 174 configured to cover the hose port 172 when the hose port 172 is not in use. The flap 174 opens, revealing an opening 176 configured to receive a hose or other object. In exemplary embodiments, the opening 176 may include seam tape or some other type of seal configured to seal the opening 176 around the hose. In some embodiments, the system 10 may include more than one port.

Figure 7:
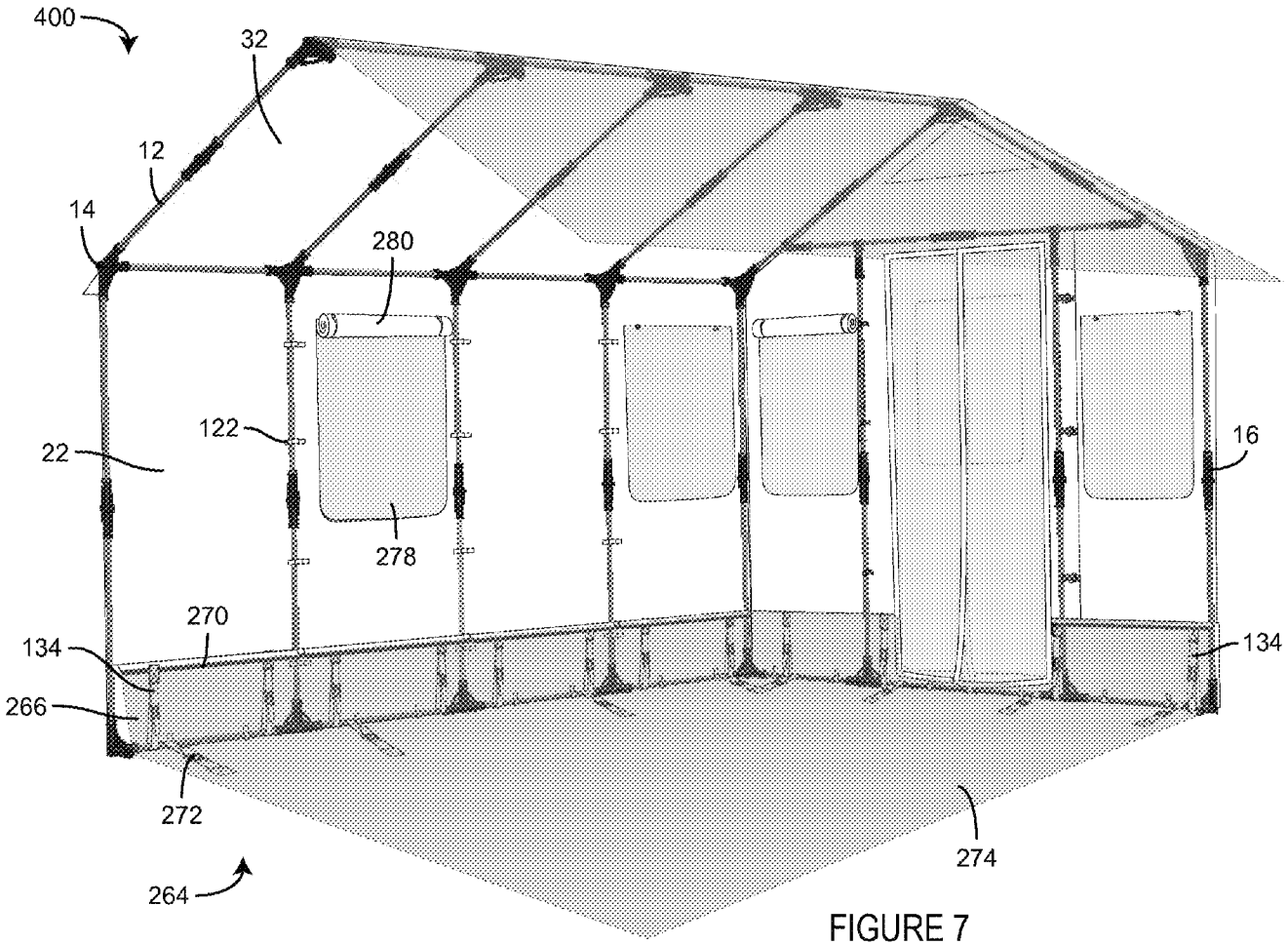
FIG. 7 is a perspective view of another enclosure utilizing the modular frame structure of FIG. 1, according to an exemplary embodiment.

Referring to FIG. 7, a perspective view of a modular frame and structure system 400 is shown, according to an exemplary embodiment. In this embodiment, wall panels 22 are shown connected by attachment straps shown as cinch straps 122. Cinch straps 122 may be positioned on the bottom, sides, and top of the wall panels 22 and configured to couple the wall panels 22 to the frame members 12 around the perimeter of the wall panels 22. In some embodiments, cinch straps 122 are positioned on each side of the roof panels 32, coupling the roof panels 32 to each other and to the framework 20. The cinch straps 122 include a strip portion 126 and a loop portion 128 coupled to each wall panel 22. The strip portions 126 may be attached to the panels 22 with glue, or may be attached to the panels 22 in any other method suitable for the particular application. The strip portions 126 are sized and configured to couple to the loop portions 128. In exemplary embodiments, the strip portion 126 wraps around the frame member 12, through the loop portion 128, and attaches to itself (e.g. by hook and loop attachment, glue, etc.), coupling the wall panel 22 to the frame member 12, and thus coupling the wall panels 22 to each other. The cinch straps 122 are adjustable and removable, and may be added to any portion of the system 10, providing an adjustable cinching ability throughout the system 10. The cinch straps 122 are shown in further detail in FIGS. 18A-C.

Referring still to FIG. 7, the wall panels 22 are also connected to base frame members 12 by base attachment straps 134, which are shown in further detail in FIG. 17. The base attachment straps 134 include closures 30 intended to secure the attachment straps 134, coupling the wall panels 22 to the frame members 12 at the base of the framework 20. The base attachment straps 134 are spaced apart from each other along the width of each wall panel 22. In the illustrated embodiment of FIG. 7, the base attachment straps 134 are stitched onto the wall panels 22. However, in other embodiments, the base attachment straps 134 may be attached to the wall panels 22 in another manner suitable for the particular application.

Figure 8:
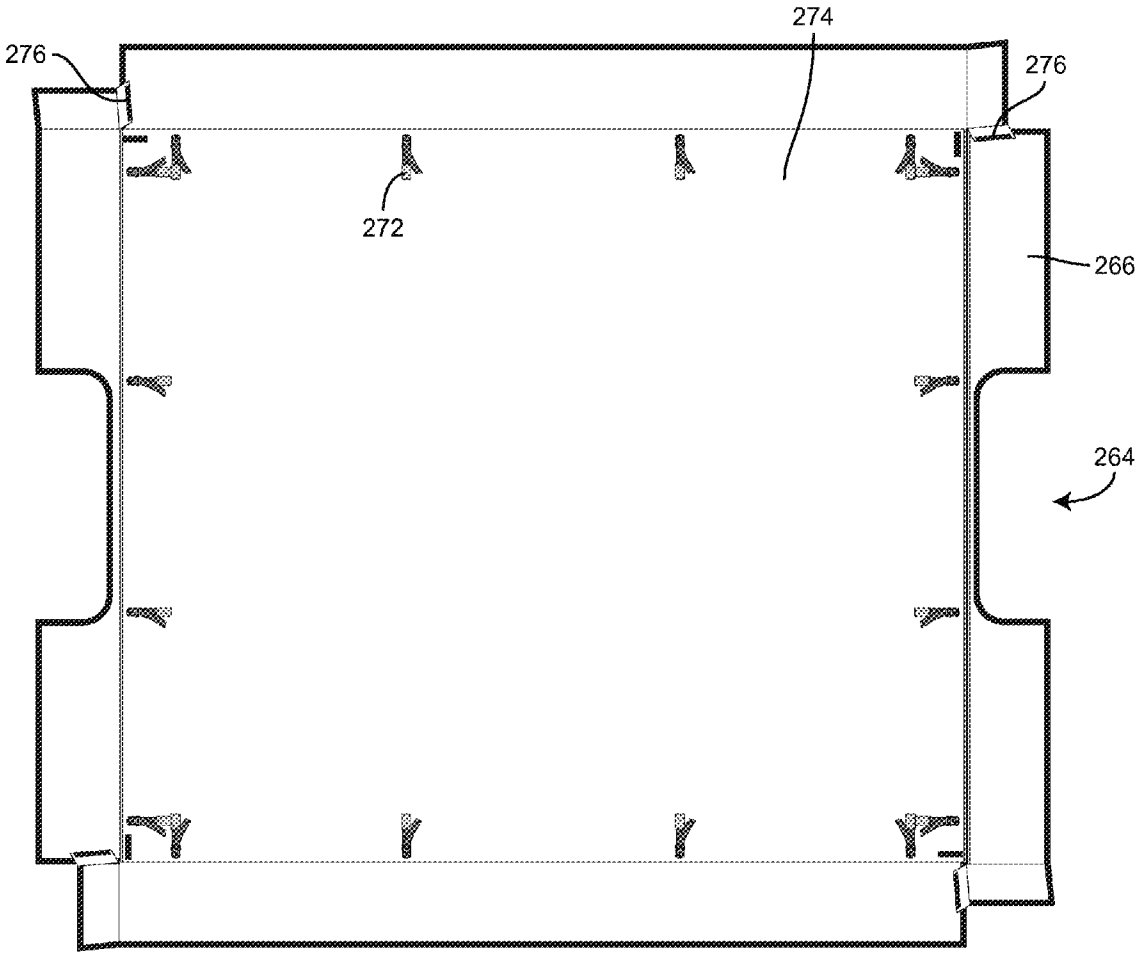
FIG. 8 is a top view of a floor mat system for the enclosure of FIG. 7, including connecting flaps and according to an exemplary embodiment.
Figure 9:
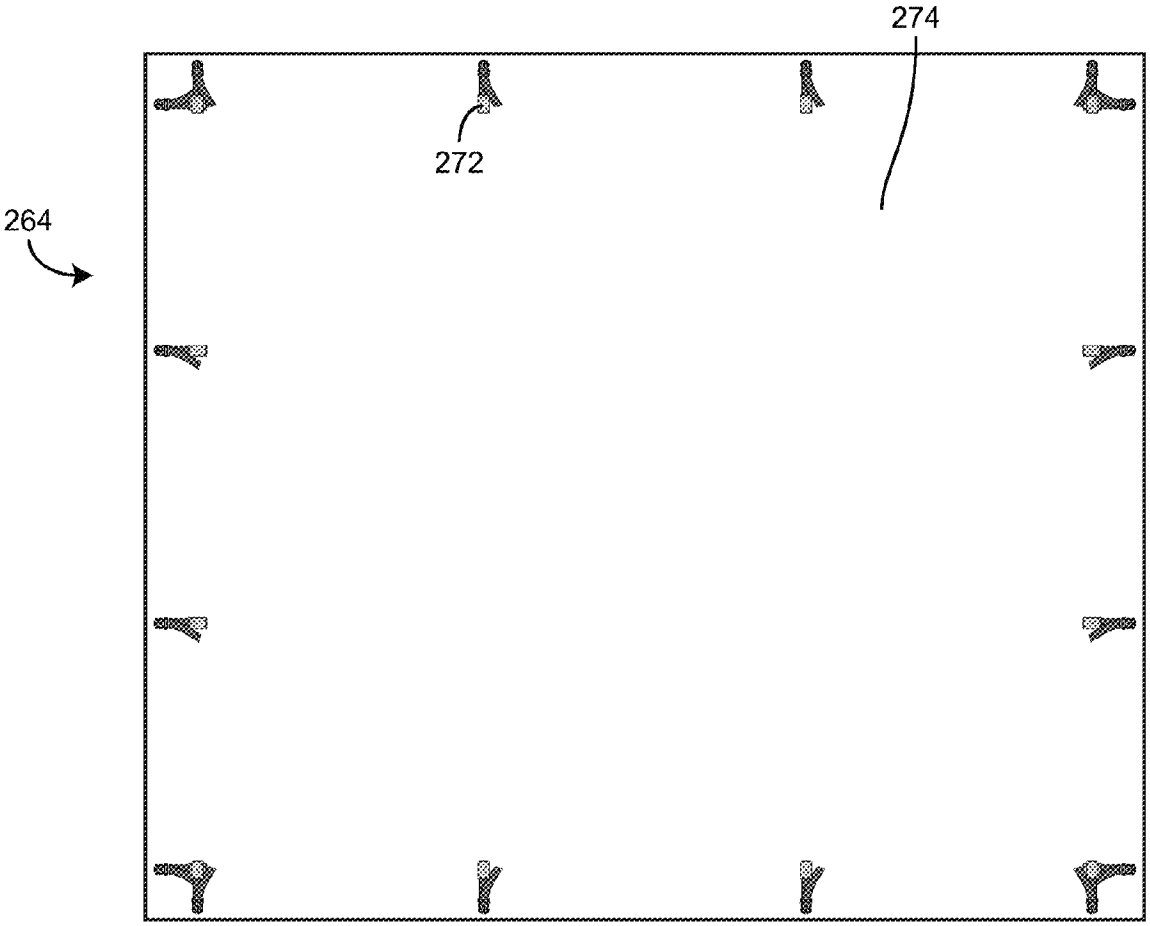
FIG. 9 is a top view of a floor surface for the enclosure of FIG. 7, according to an exemplary embodiment.
Figure 10B:
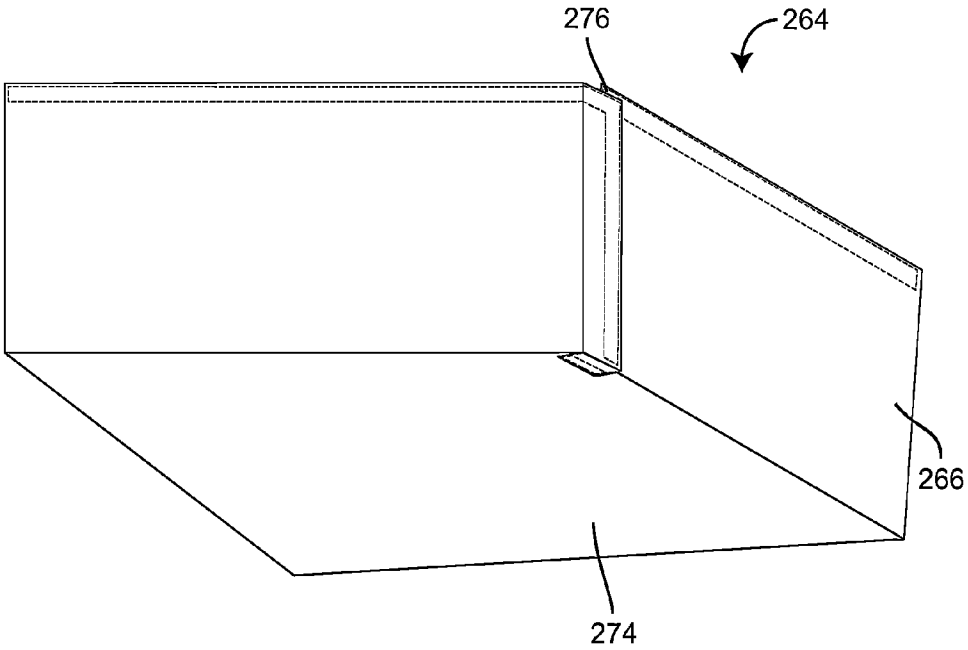
FIG. 10B is a perspective view of the corner flaps of FIG. 10A, including the floor mat system of FIG. 8.
Figure 10A:
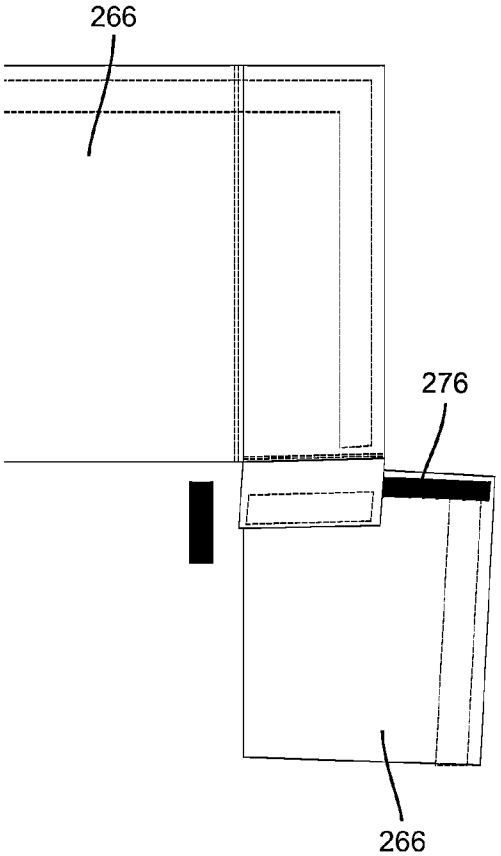
FIG. 10A is a close-up top view of corner flaps for the floor mat system of FIG. 8.
Figure 11:
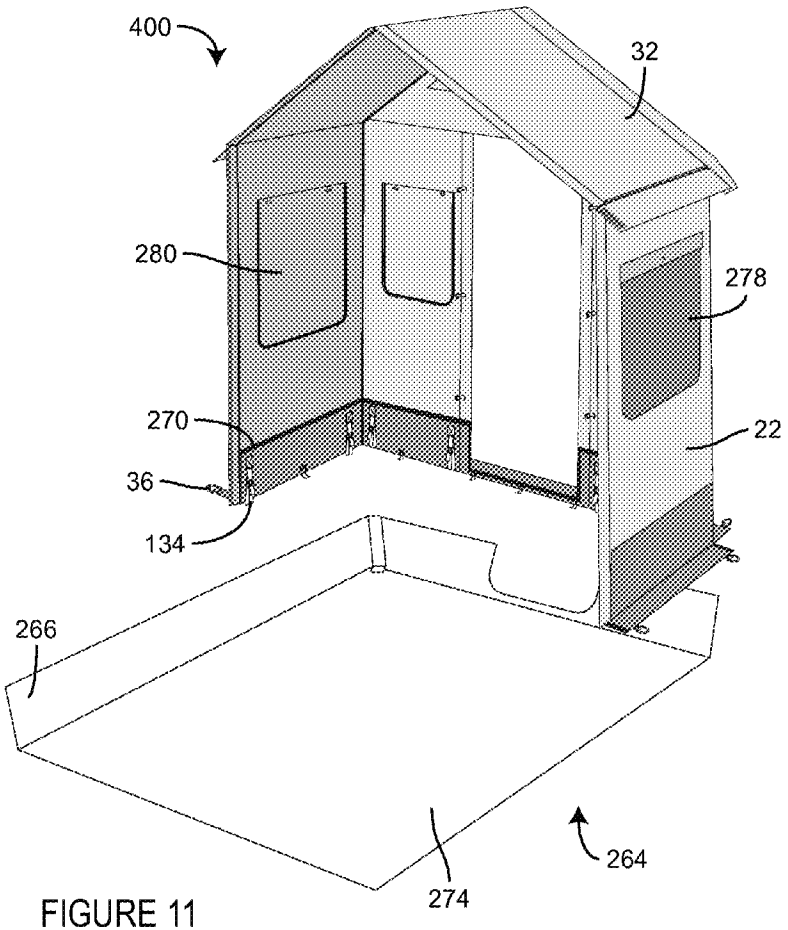
FIG. 11 is an exploded perspective view of the enclosure of FIG. 7, including the floor mat system of FIG. 8.
Figure 12:
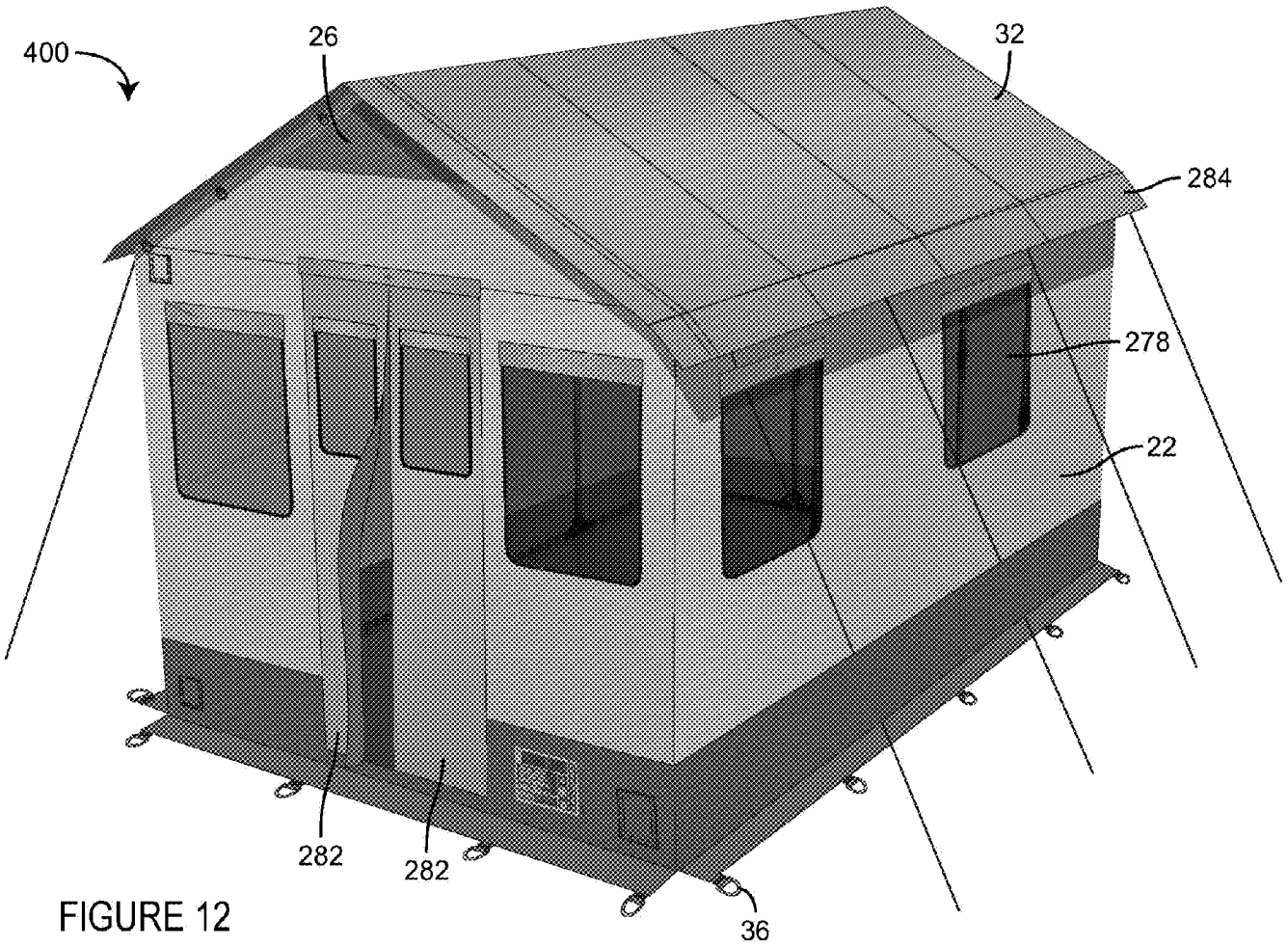
FIG. 12 is a perspective view of another enclosure utilizing the structure of FIG. 1, according to an exemplary embodiment.
Figure 13B:
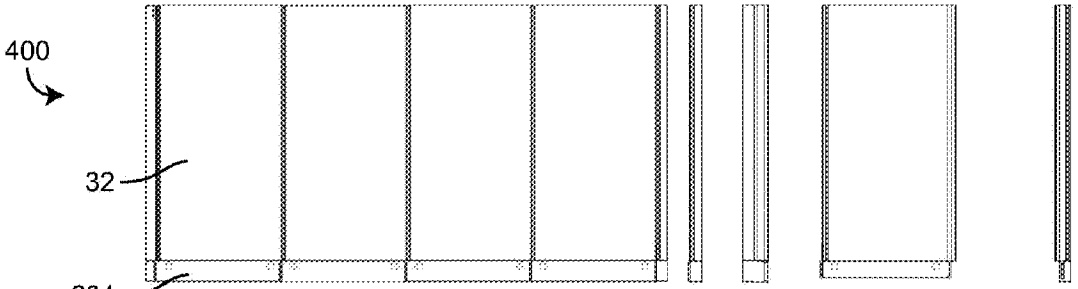
FIG. 13B is a top view of the enclosure of FIG. 12.
Figure 13C:
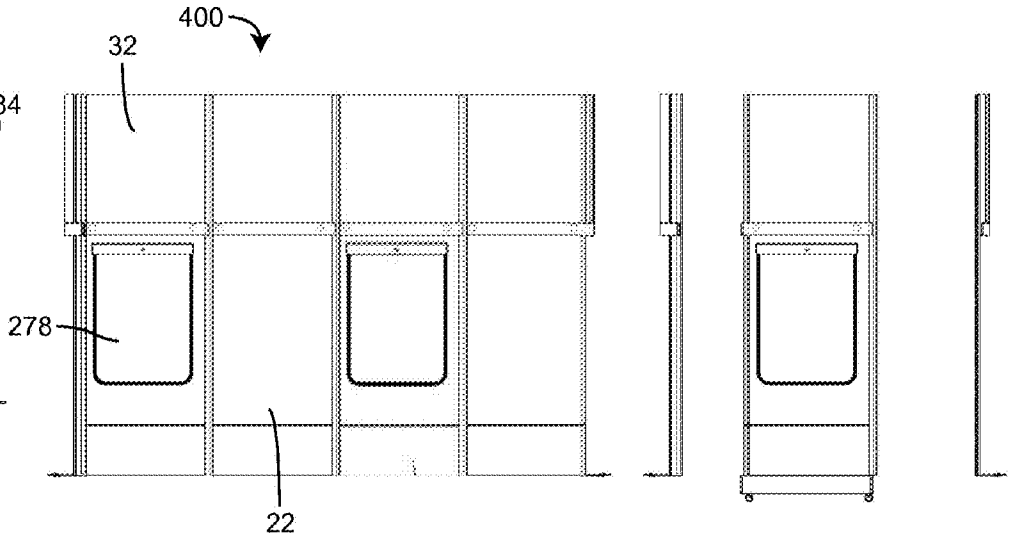
FIG. 13C is a side view of the enclosure of FIG. 12.
Figure 13A:
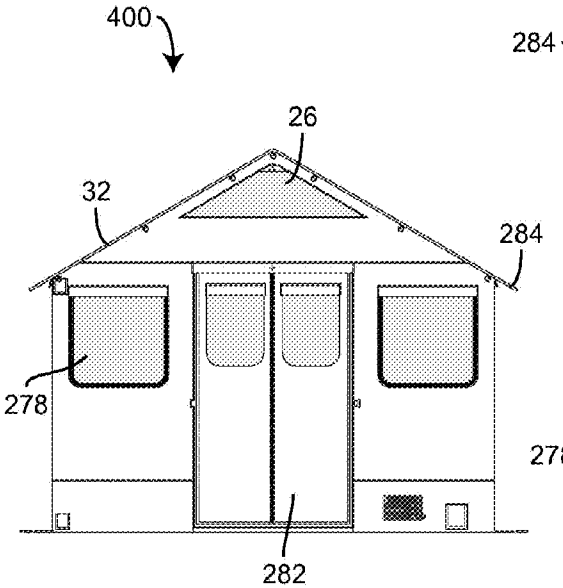
FIG. 13A is a front view of the enclosure of FIG. 12.

Referring to FIGS. 7-11, the system 400 may include a floor mat system 264 providing a floor surface 274 for the modular frame and structure system 400. The floor mat system 264 is configured to seal the bottom portion of the system 400 from the outside elements (e.g. rain, dirt, etc.). The floor mat system 264 includes flaps 266 that extend along the perimeter of the floor surface 274. In exemplary embodiments, the flaps 266 fold upward from the floor surface 274 approximately perpendicular to the ground, extending approximately parallel to the wall panels 22 of the modular frame and structure system 400. The flaps 266 are coupled to the wall panels 22 by connecting to a hook and loop strip 270 that is positioned on the lower half of the wall panels 22. Once coupled to the wall panels 22, the flaps 266 form a seal with the wall panels 22. The floor mat system 264 also includes hook and loop strips 272 that are configured to connect to frame members 12 of the system 400, coupling the floor mat system 264 to the modular frame and structure system 400. Along with providing a floor for the system 400, the floor mat system 264 provides a barrier between the system 400 and the ground, preventing dirt and other debris from entering the system 400. FIGS. 8 and 9 provide top views of the floor mat system 264 and the floor surface 274, respectively. FIG. 11 is an exploded perspective view of the floor mat system 264 and a section of the modular frame and structure system 400.

Referring to FIGS. 10A-B, the flaps 266 of the floor mat system 264 are shown in greater detail, and according to an exemplary embodiment. In this embodiment, the flaps 266 fold up from the floor surface 274, forming corners to provide a seal with the modular frame and structure system 400. The corners of the flaps 266 include hook and loop connectors 276 configured to couple the flaps 266 of two adjacent sides, forming a corner as shown in FIG. 10B. The floor mat system 264 is coupled to the modular frame and structure system 400, sealing the system 400 from outside elements.

Referring to FIGS. 12 and 13A-C, a cover configuration is shown for the modular frame and structure system 400, according to an exemplary embodiment. In this embodiment, the cover 284 includes wall panels 22 having mesh windows 278. The mesh windows 278 are made from a mesh (i.e. semi-permeable) material, having space to allow air to travel through the windows 278, and venting the modular frame and structure system 400. In exemplary embodiments, the mesh windows 278 are permeable enough to allow air to flow through the system 400, but the material also prevents mosquitoes and other insects from entering the system 400. The system 400 may also include internal window panels 280 (shown in FIG. 7) sized to fit over the mesh windows 278. In some embodiments, the internal window panels 280 include a zipper for closing over the mesh windows 278, providing a seal over the mesh windows 278 when closed. In the illustrated embodiment of FIGS. 12 and 13A-C, the modular frame and structure system 400 also includes door flaps 282. The door flaps 282 include a zipper configured to open and close the door flaps 282. The door flaps 282 may also include mesh windows 278 for venting the modular frame and structure system 400, and internal window panels 280 for sealing the mesh windows 278. The modular frame and structure system 400 may include any number of mesh windows 278 and internal window panels 280 as is desirable, or as is suitable for a particular application.

Figures 14A, 14B:
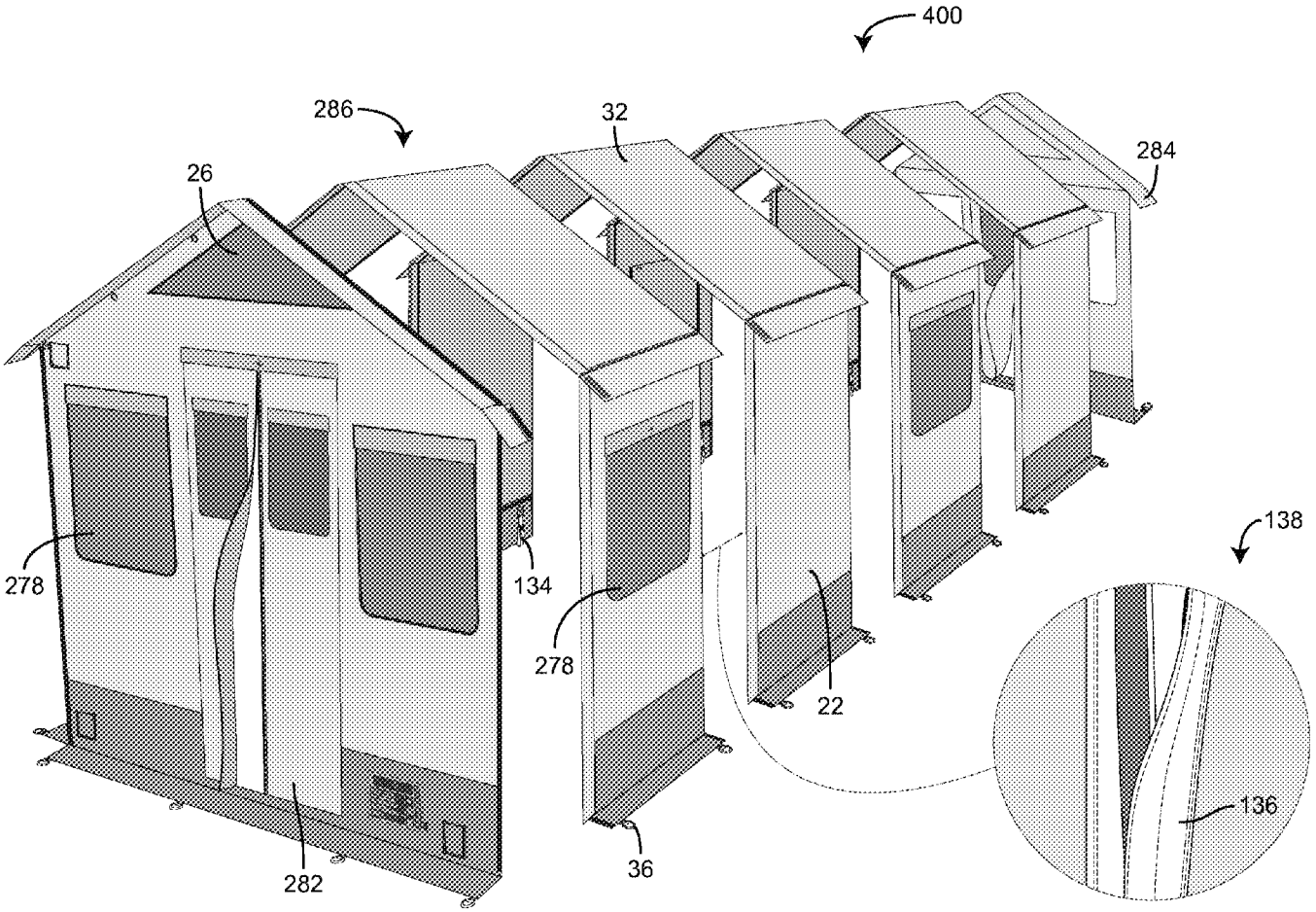
FIG. 14A is an exploded perspective view of the enclosure of FIG. 12, including a plurality of enclosure sections.
FIG. 14B is a close-up view of a zipper flap for the enclosure of FIG. 12.
Figure 15:
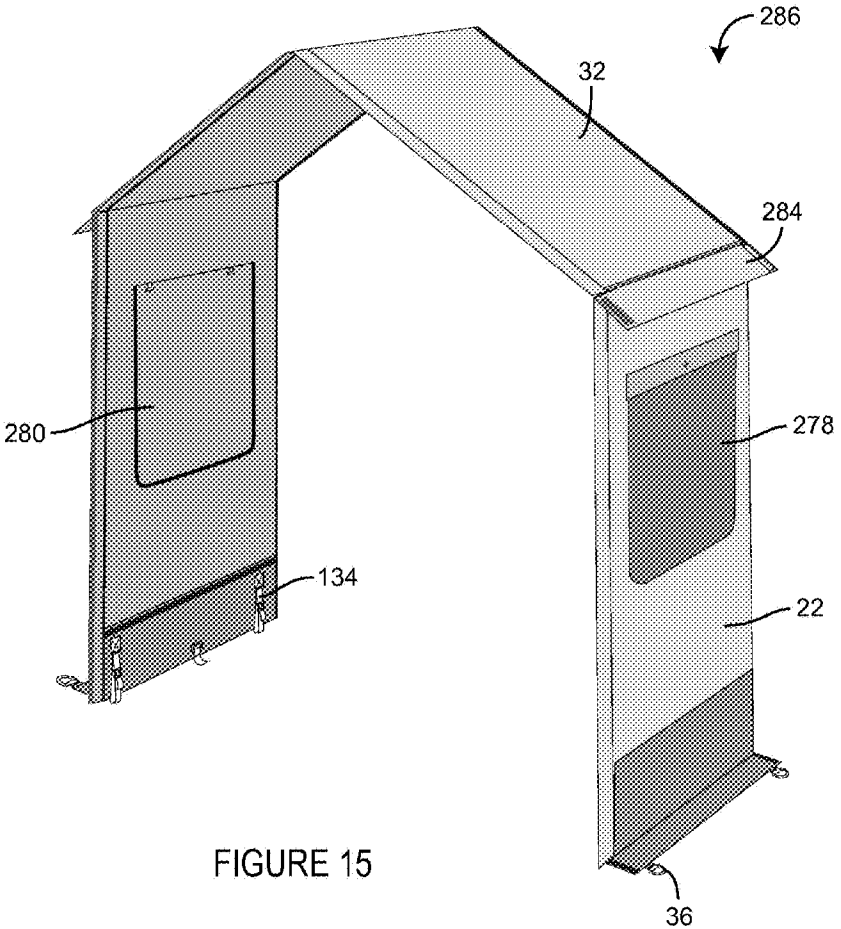
FIG. 15 is a perspective view of an enclosure section of FIG. 14A.

Referring to FIGS. 14A-B and 15, an exploded view of the cover 284 for the modular frame and structure system 400 is shown, according to an exemplary embodiment. In this embodiment, the cover 284 includes sections 286 formed by one or more wall panels 22 coupled to one or more roof panels 32 (an isolated view of a section 286 is shown in FIG. 15). In other embodiments, the cover 284 may include a plurality of non-sectional wall panels 22 and roof panels 32. In some embodiments, the sections 286 are coupled by zippers 138 (shown in FIG. 14B). The zippers 138 may be two-sided, or dual zippers, configured to be opened and/or closed from either side of the cover 284. The zippers 138 may also be one-sided zippers, or single pull zippers. In exemplary embodiments, the zippers 138 are compatible and able to connect with each other zipper 138 of the cover 284, so that sections 286 may be removed and/or replaced from the cover 284. Referring to FIG. 14B, the cover 284 may also include zipper flaps 136 that cover the connecting zippers 138 between the sections 286. The zipper flaps 136 are intended to provide a seal between the sections 286, protecting the system 400 from the outside elements. The zipper flaps 136 may include hook and loop fasteners intended to provide a seal by connecting flaps 136 of two or more adjacent sections 286. In other embodiments, the zipper flaps 136 may utilize another type of fastener suitable for the application.

Figures 16A, 16B:
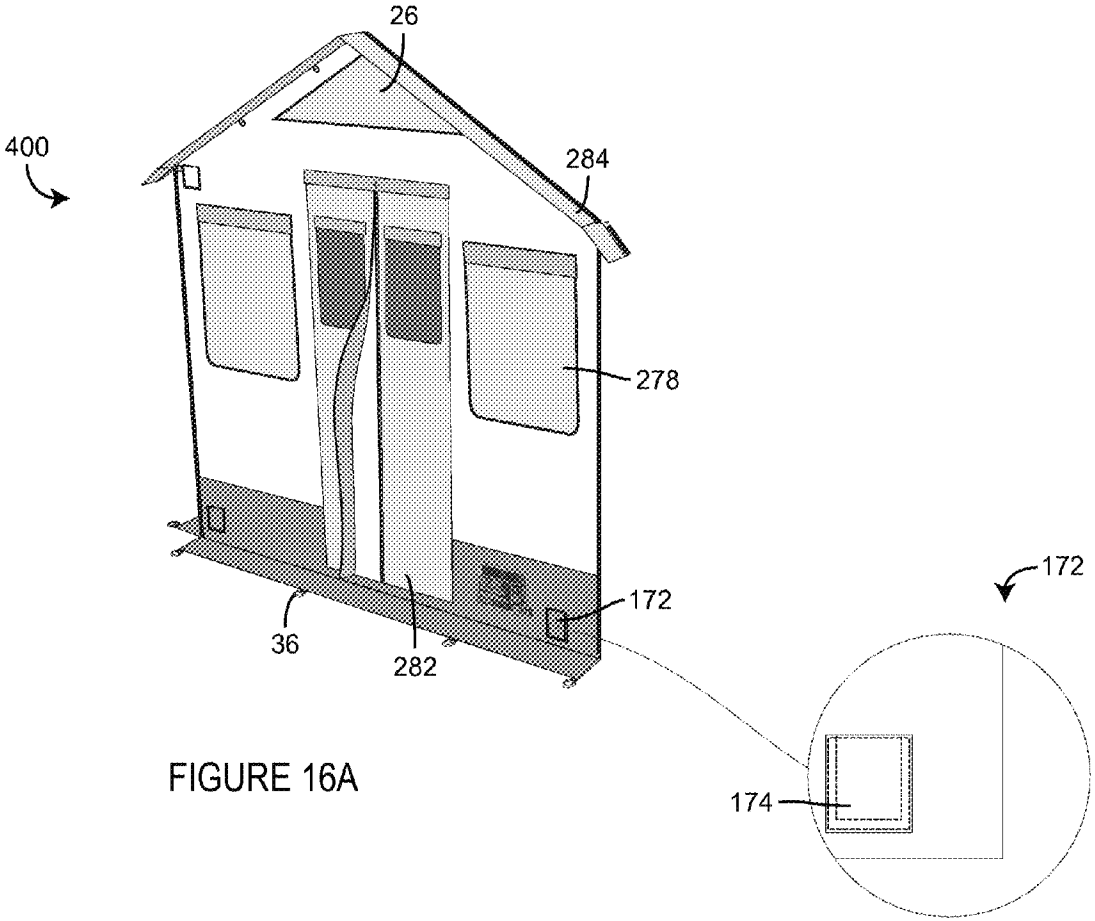
FIG. 16A is a perspective view of a front side of the enclosure of FIG. 12, including a door having flaps.
FIG. 16B is an isolated view of a hose port for the enclosure of FIG. 12, according to an exemplary embodiment.

Referring to FIGS. 16A-B, the system 400 may include a port (e.g. port hole, hose port, tubing port, etc.) such as hose port 172. The hose port 172 is configured to receive a hose for introducing a fluid into the system 400. For instance, the hose port 172 may receive a hose configured to introduce water for watering plant life, agriculture or livestock, etc. within the system 400. The hose port 172 includes a flap 174 for covering the hose port 172 when the hose port 172 is not in use. In some embodiments, the system 400 may include more than one port. In the illustrated embodiment of FIGS. 16A-B, the hose port 172 is located at the bottom of the system 400, but in other embodiments the system 400 may include ports in any location suitable for the particular application.

Figure 17B:
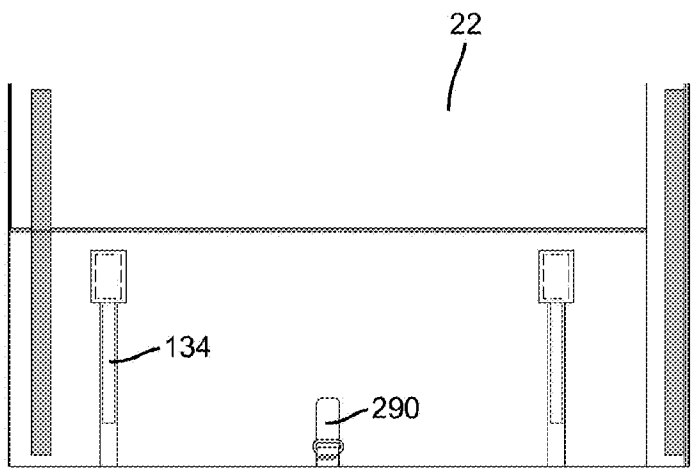
FIG. 17B is an isolated front view of the wall panels of FIG. 17A, including a hook and loop cinch system.
Figure 17A:
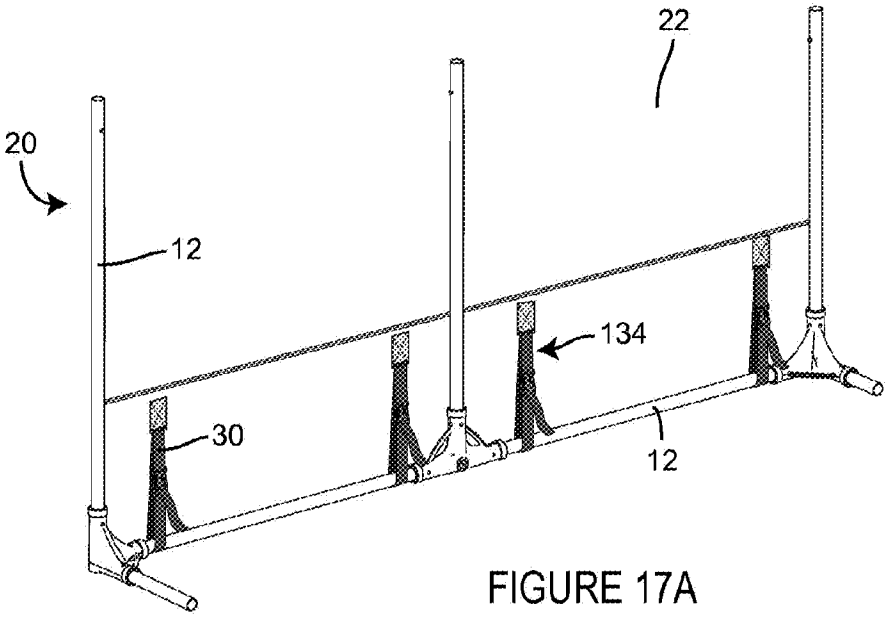
FIG. 17A is an isolated perspective view of wall panels for the enclosure of FIG. 12, including straps for connecting the wall panels to the modular framework.

Referring to FIG. 17A, wall panels 22 of the modular frame and structure system 400 are connected to base frame members 12 by base attachment straps 134. The base attachment straps 134 include closures 30 intended to secure the attachment straps 134, coupling the wall panels 22 to the frame members 12 at the base of the framework 20. The base attachment straps 134 are spaced along the width of the wall panels 22 in order to maintain a seal along the perimeter of the wall panels 22. In the illustrated embodiment of FIG. 17, the base attachment straps 134 are stitched onto the wall panels 22. However, in other embodiments, the base attachment straps 134 may be attached to the wall panels 22 by any other manner suitable for the application.

Referring to FIG. 17B, the wall panels 22 may also include a cinch system 290. The cinch system 290 is also used to couple the wall panels 22 to the frame members 12. The cinch system 290 is positioned in between two or more base attachment straps 134 along the frame members 12 that run along the bottom of the framework 20. The cinch system 290 couples the wall panels 22 to the frameworks 20 and further seals the system 400 from the outside elements. In other embodiments, the wall panels 22 may not include the cinch system 290, or the wall panels 22 may be coupled to the framework 20 by another manner suitable for the application.

Figure 18B:
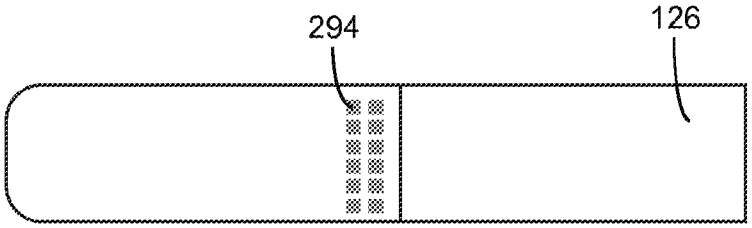
FIG. 18B is a flat view of a strip portion for the cinch strap of FIG. 18A.
Figure 18C:
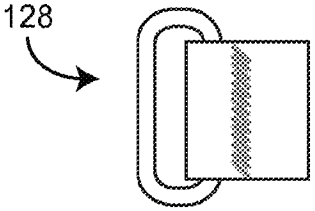
FIG. 18C is a flat view of a loop portion for the cinch strap of FIG. 18A.
Figure 18A:
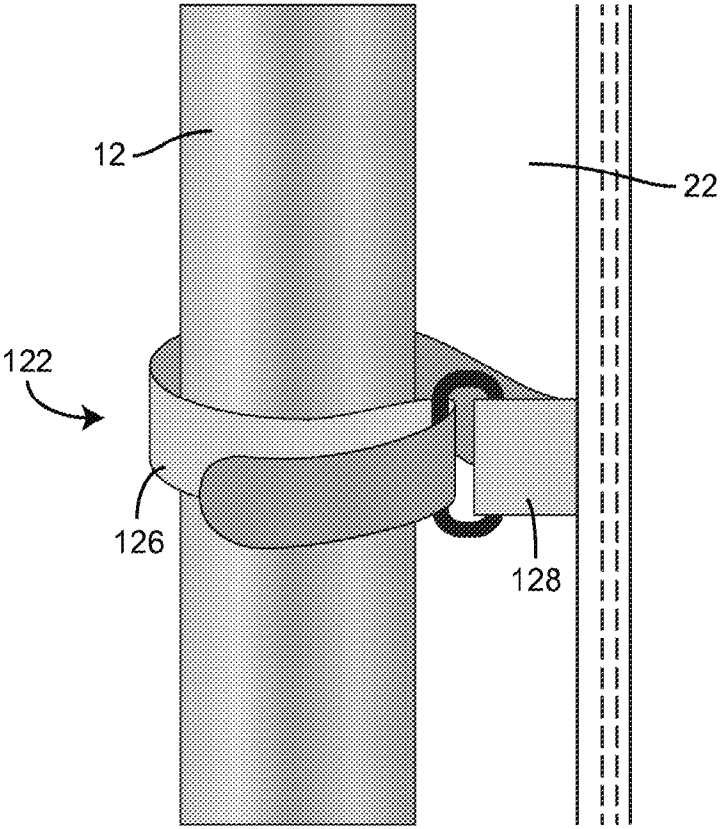
FIG. 18A is a close-up view of a cinch strap connected to a frame member, according to an exemplary embodiment.

Referring to FIGS. 18A-C, a cinch strap 122 is shown attached to a frame member 12, according to an exemplary embodiment. The cinch strap 122 includes a strip portion 126 which may be coupled to the wall panel 22, and also includes a loop portion 128 also coupled to the wall panel 22. The strip portion 126 wraps around the frame member 12, through the loop portion 128, and is coupled to itself (e.g. by a hook and loop attachment, glue, etc.), securing the wall panel 22 to the frame member 12. As shown in FIG. 18B, the strip portion may include a heat weld 294. The heat weld 294 is positioned on the strip portion 126 such that it aligns with the loop portion 128 when the cinch strap 122 is secured to the frame member 12. The heat weld 294 is intended to provide added durability to the cinch strap 122. In an exemplary embodiment, the strip portion 126 extends at least approximately two inches past the loop portion 128 when the cinch strap 122 is secured to the frame member 12. The modular frame and structure system 400 may include any number of cinch straps 122 configured to secure a fabric portion of the cover 284 to a portion of the framework 20.

Figure 19B:
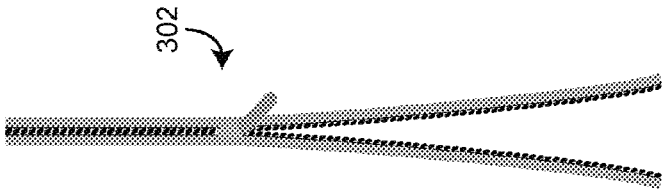
FIG. 19B is a single pull zipper for connecting the door panels of FIG. 19A.
Figure 19A:
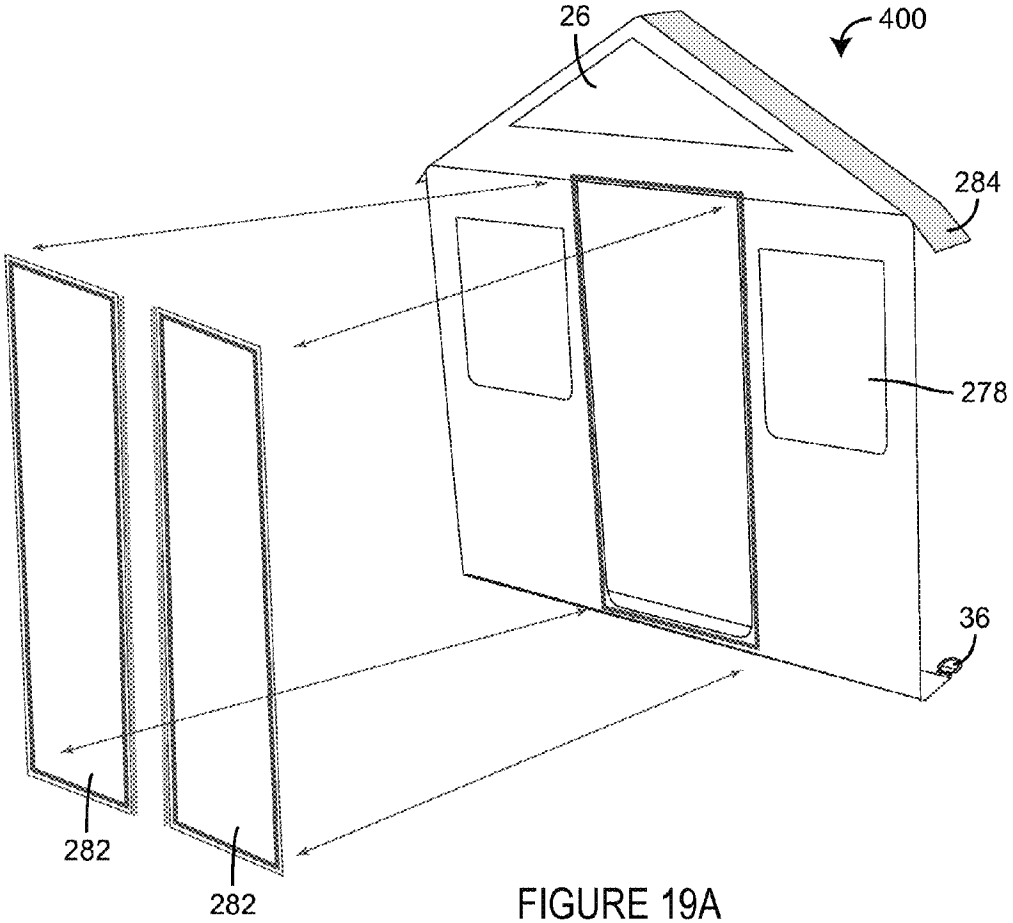
FIG. 19A is an exploded perspective view of door panels for the enclosure of FIG. 12, according to an exemplary embodiment.

Referring to FIGS. 19A-B, the door flaps 282 are shown removed from the modular frame and structure system 400, according to an exemplary embodiment. The door flaps 282 include a zipper assembly 302 around the perimeter of each door flap 282. In this embodiment, the door flaps 282 are coupled to each other and to the cover 284 by moving the zipper assembly 302 in a first direction, but are also removable by moving the zipper assembly 302 in a second direction. The door flaps 282 may be removed from the cover 284 by pulling the zipper assembly 302 until the door flap 282 is removed from the cover 284, as shown in FIG. 19A.

Figure 20A:
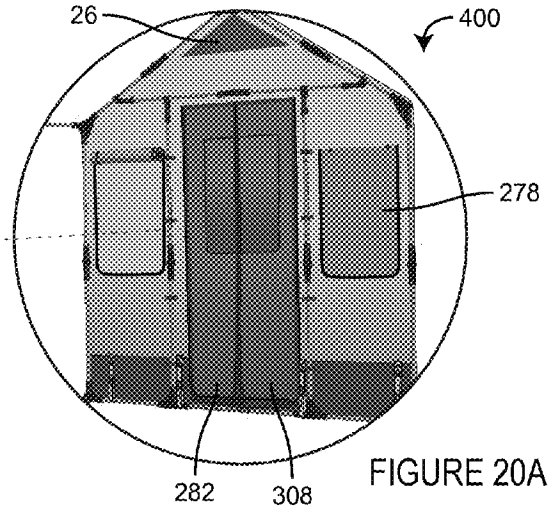
FIGS. 20A-C are perspective views of door flaps for the enclosure of FIG. 12, including a toggle and lanyard for storing and securing the door flaps.
Figure 20B:
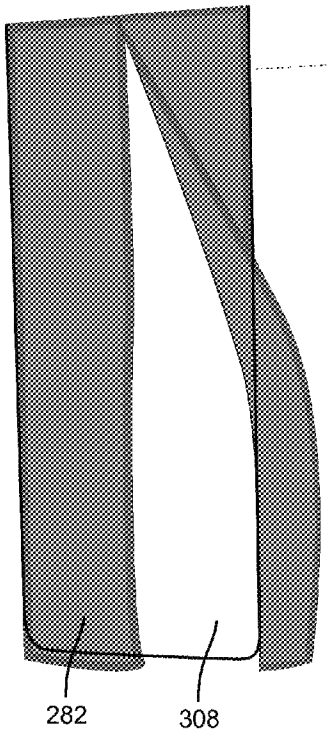
Figure 20C:
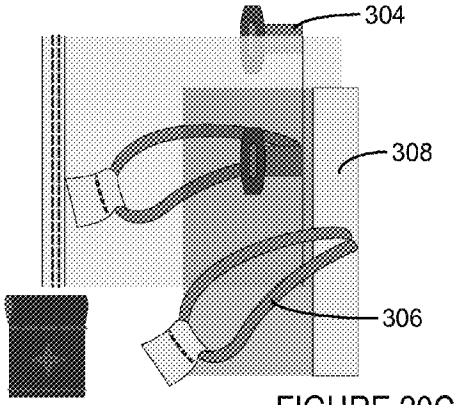
Figure 22C:
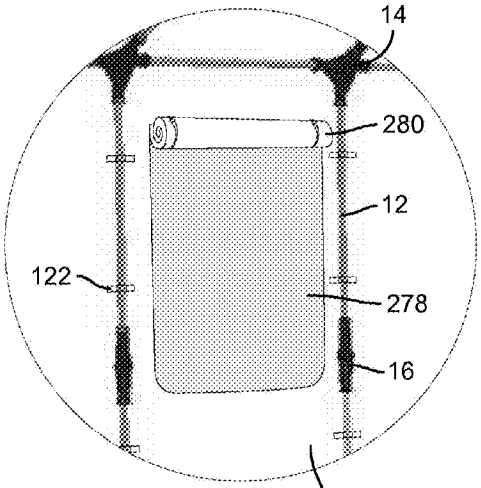
FIG. 22C is a perspective view of a mesh panel and window zipper frame stored above the mesh panel, according to an exemplary embodiment.
Figure 22D:
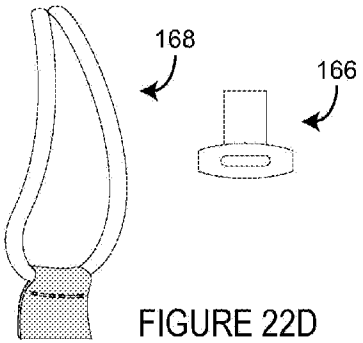
FIG. 22D is an isolated view of a toggle and elastic cord for storing a window zipper frame, according to an exemplary embodiment.

Referring to FIGS. 20A-C, the door flaps 282 are shown in further detail, along with storage hardware shown as a toggle 304 and an elastic cord 306 for the door flaps 282. In exemplary embodiments, the door flaps 282 open away from the entrance to the system 400, revealing a screen door 308. In the illustrated embodiment of FIG. 20A, the screen door 308 is located behind the door flaps 282. When the door flaps 282 are in the open position (as the right door flap 282 is shown in FIG. 20B), the door flaps 282 are stored by a toggle 304 sized to connect to an elastic cord 306 and configured to secure the door flaps 282. In exemplary embodiments, the elastic cord 306 is attached to the screen door 308, and the toggle 304 is positioned in between the screen door 308 and the door flaps 282. The door flaps 282 are positioned to fold or bunch in between the elastic cord 306 and the toggle 304, and the elastic cord 306 and toggle 304 are configured to connect to each other, holding the door flaps 282 away from the doorway. The screen door 308 may be made from a mesh material and configured to provide a vent for the modular frame and structure system 400.

Figure 21:
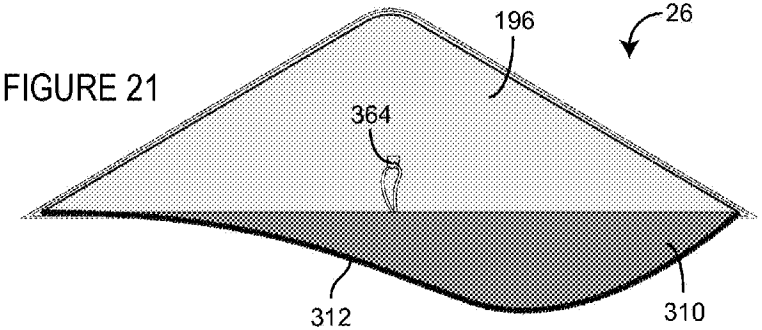
FIG. 21 is a close-up front view of a mesh vent for the enclosure of FIG. 12, according to an exemplary embodiment.
Figure 22B:
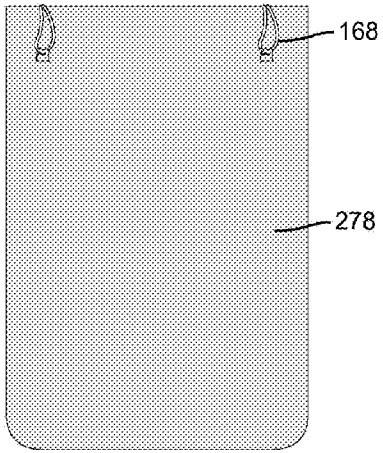
FIG. 22B is a front view of a mesh panel for the enclosure of FIG. 12, according to an exemplary embodiment.
Figure 22A:
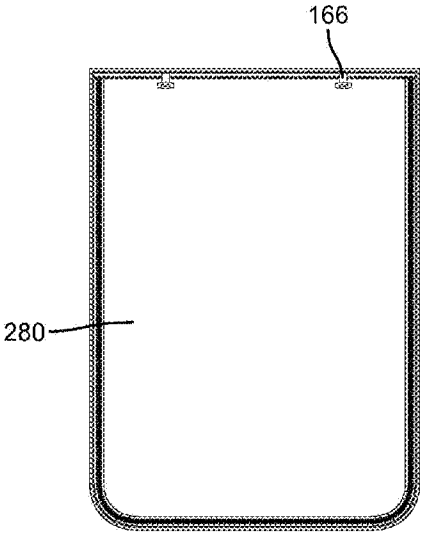
FIG. 22A is a front view of a window zipper frame for the enclosure of FIG. 12, according to an exemplary embodiment.

Referring to FIG. 21, a close-up view of the vent 26 of FIG. 7 is shown. In an exemplary embodiment, the vent 26 includes a mesh vent window 196 for venting the modular frame and structure system 400. The mesh vent window 196 is also configured to prevent insects or debris from entering the system 400. The vent 26 also includes an outer window 310 for sealing the vent window 196 from the outside environment. The outer window 310 includes a double zipper 312 for closing over the mesh vent window 196. The vent 26 may also include a fastener such as the elastic cord 364 for holding and storing the outer window 310 above or below the vent window 196 when the outer window 310 is open.

Referring to FIGS. 22A-D, the mesh windows 278 and internal window panels 280 of the modular frame and structure system 400 are shown in greater detail. The internal window panels 280 are sized to fit over the mesh windows 278 in order to close over the mesh windows 278 and provide a seal for the system 400. The internal window panels 280 are located within the system 400. The internal window panels 280 can be rolled up above the mesh windows 278 to reveal the mesh windows 278. The internal window panels 280 are opened by a zipper that runs along the perimeter of the internal window panels 280 and connects with the cover 284. In exemplary embodiments, the internal window panels 280 are stored by wrapping the toggle 166 around the opened window panel 280 and connecting the toggle 166 to the elastic cord 168, securing the window panel 280 in an opened position (shown in FIG. 22C) above the mesh window 278.

Figure 23:
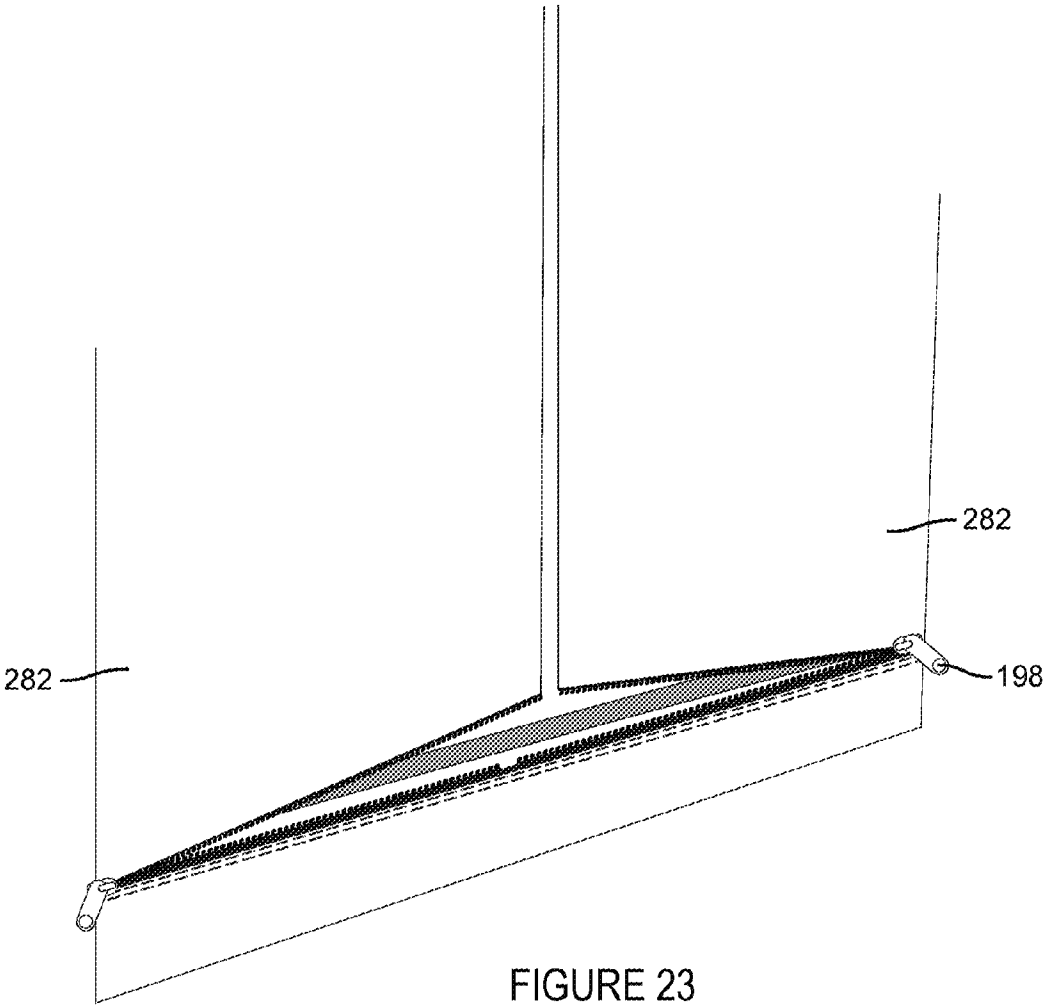
FIG. 23 is an isolated perspective view of the door flaps of FIGS. 20A-B, including zippers for closing the door flaps.

Referring to FIG. 23, a close-up view of a bottom portion of the door flaps 282 is shown, according to an exemplary embodiment. In this embodiment, the door flaps 282 also include a zipper 198 positioned on the bottom of the door flaps 282 used to open and close the door flaps 282.

Figure 24:
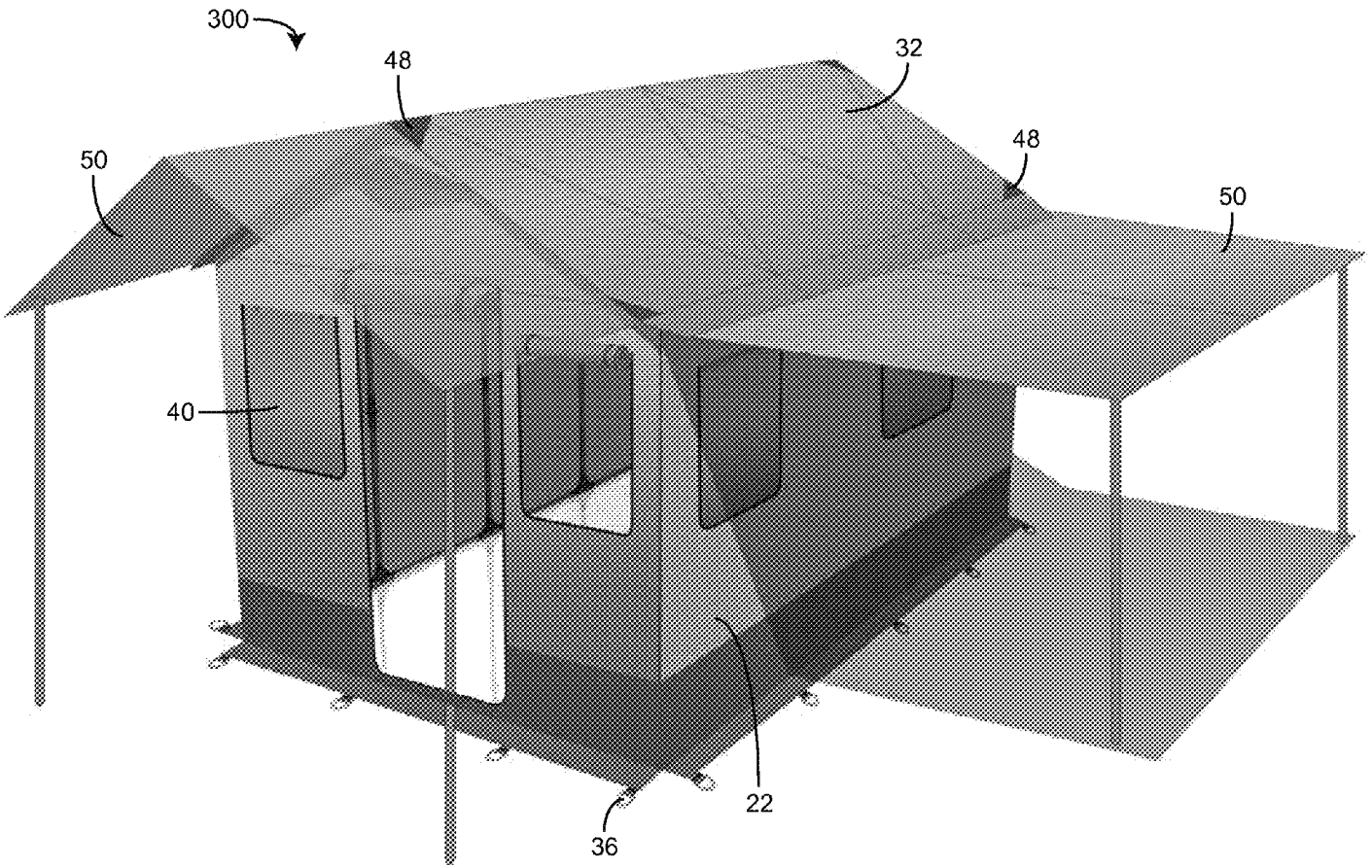
FIG. 24 is a perspective view of another enclosure utilizing the modular frame structure of FIG. 1, the enclosure including a canopy.
Figure 25:
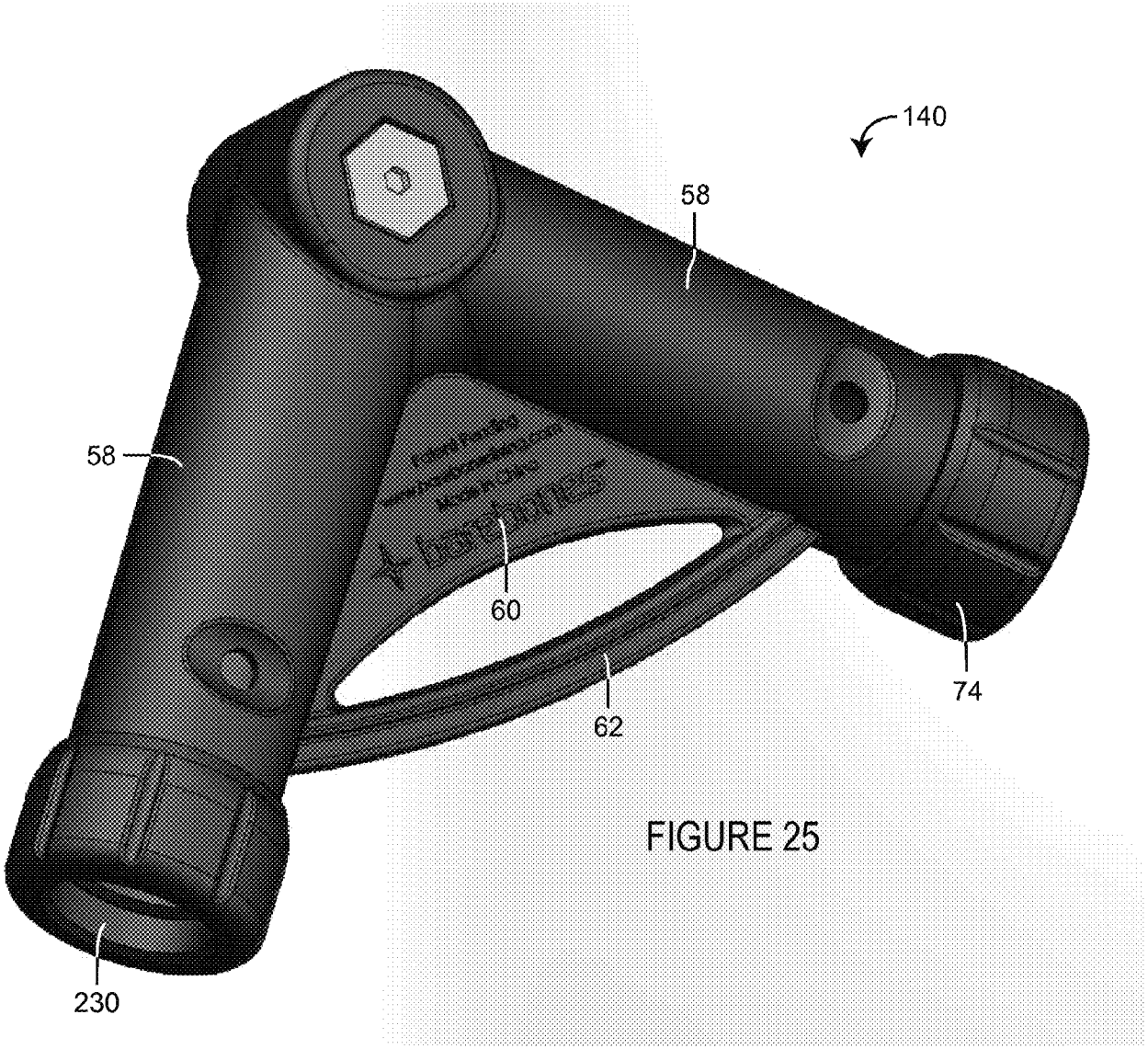
FIG. 25 is a perspective view of a two-point connector for a modular frame structure, according to an exemplary embodiment.
Figure 26:
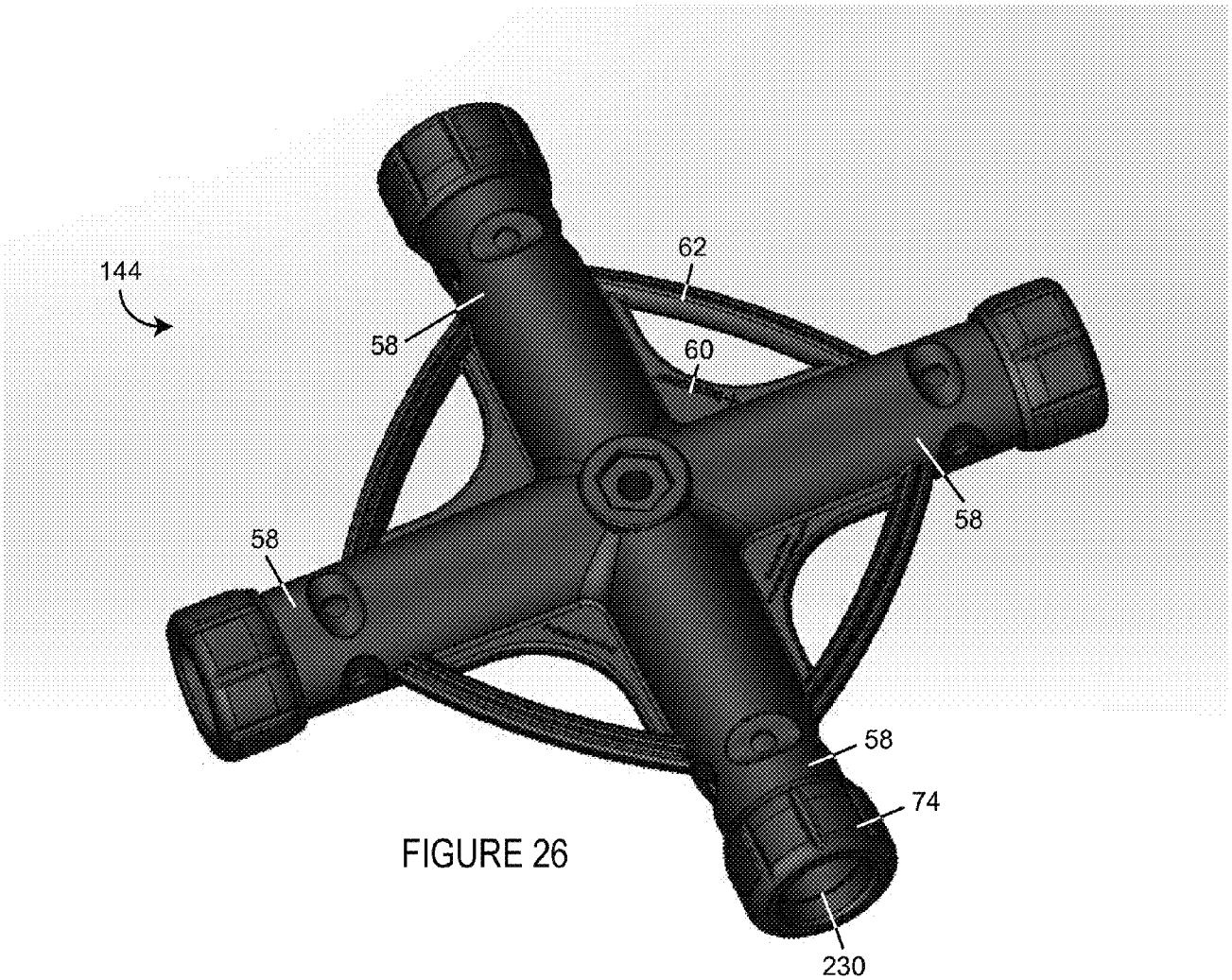
FIG. 26 is a perspective view of a four-point connector for a modular frame structure, according to an exemplary embodiment.
Figure 27:
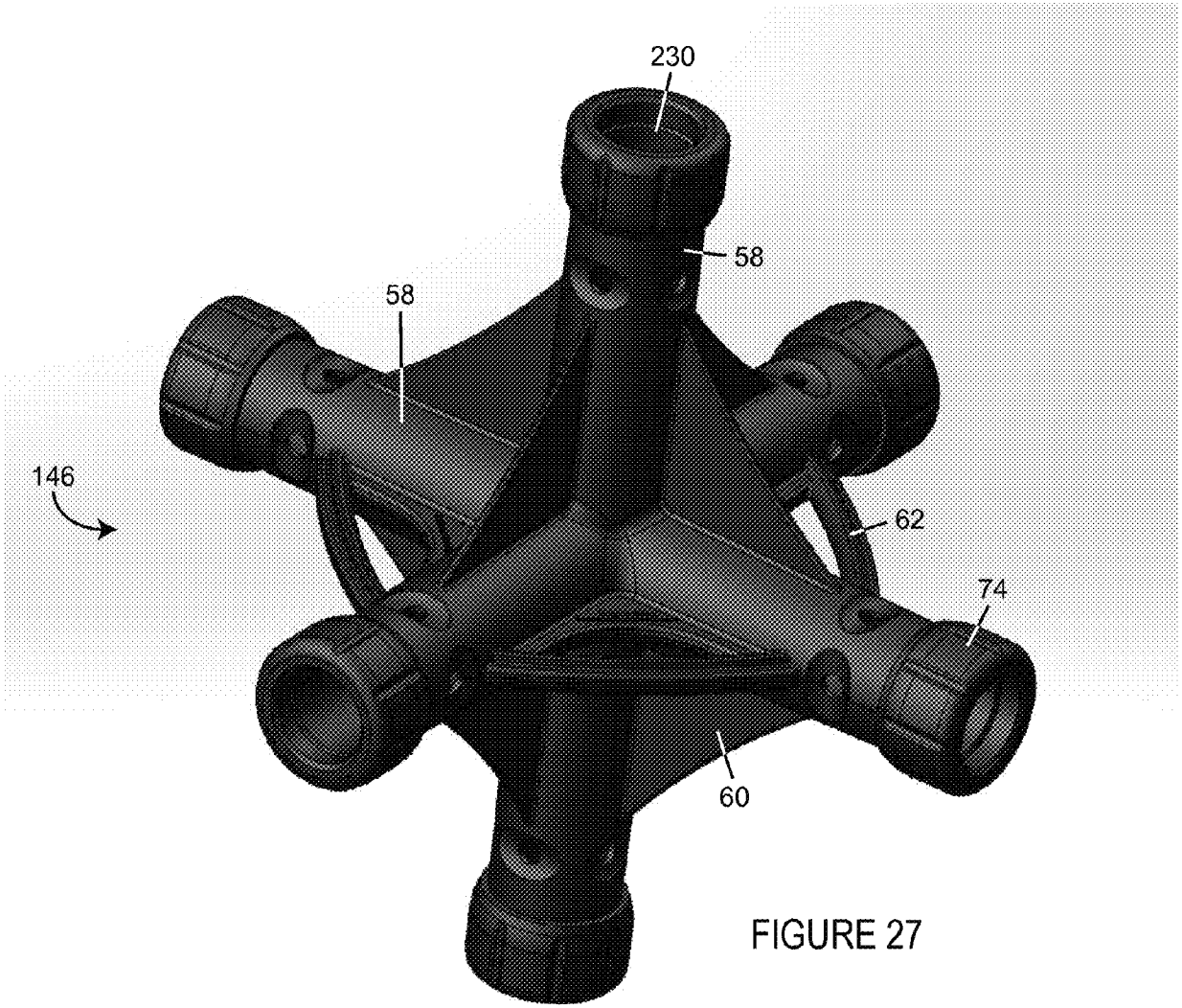
FIG. 27 is a perspective view of another six-point connector for a modular frame structure, according to an exemplary embodiment.
Figure 28:
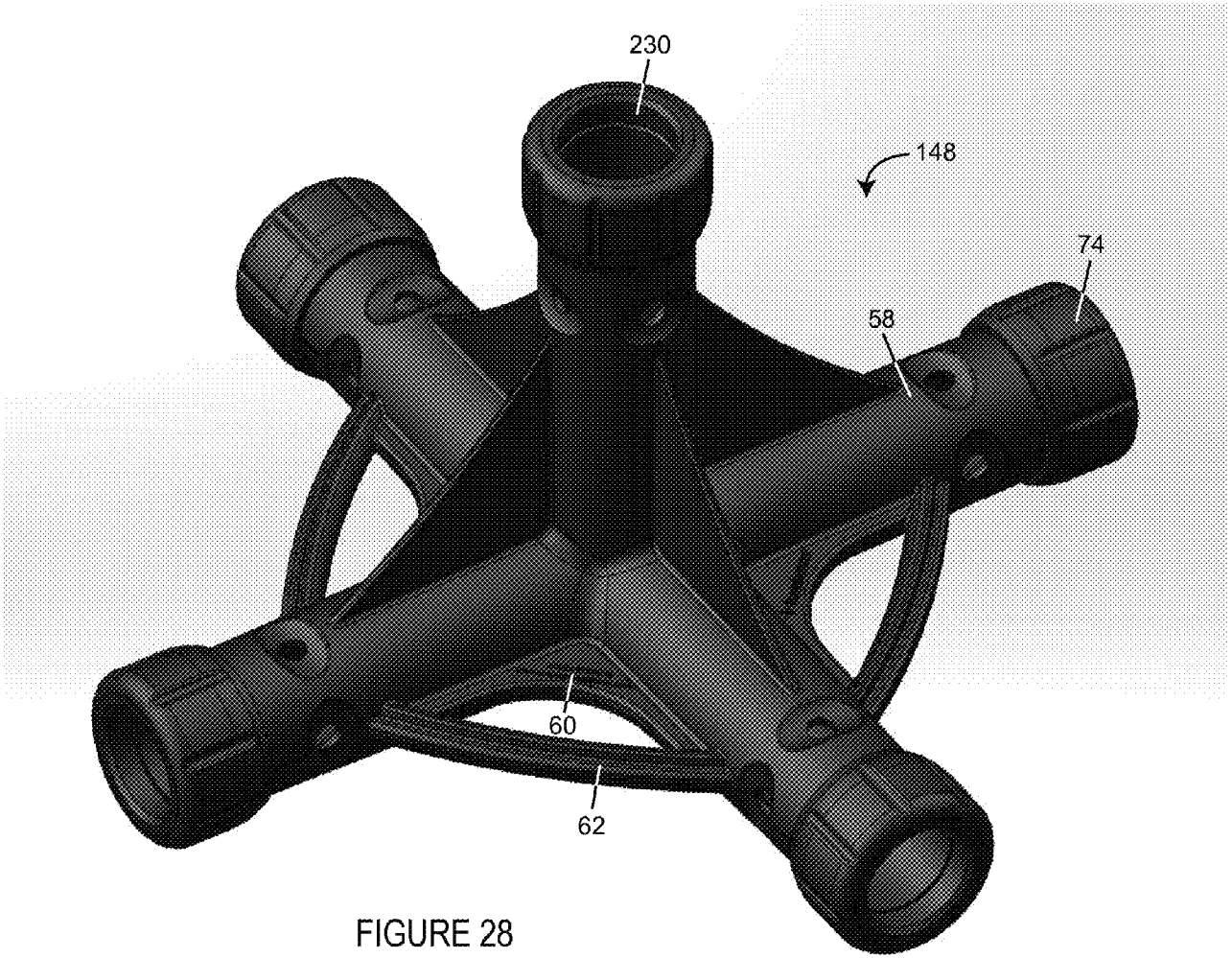
FIG. 28 is a perspective view of a five-point connector for a modular frame structure, according to an exemplary embodiment.
Figure 29:
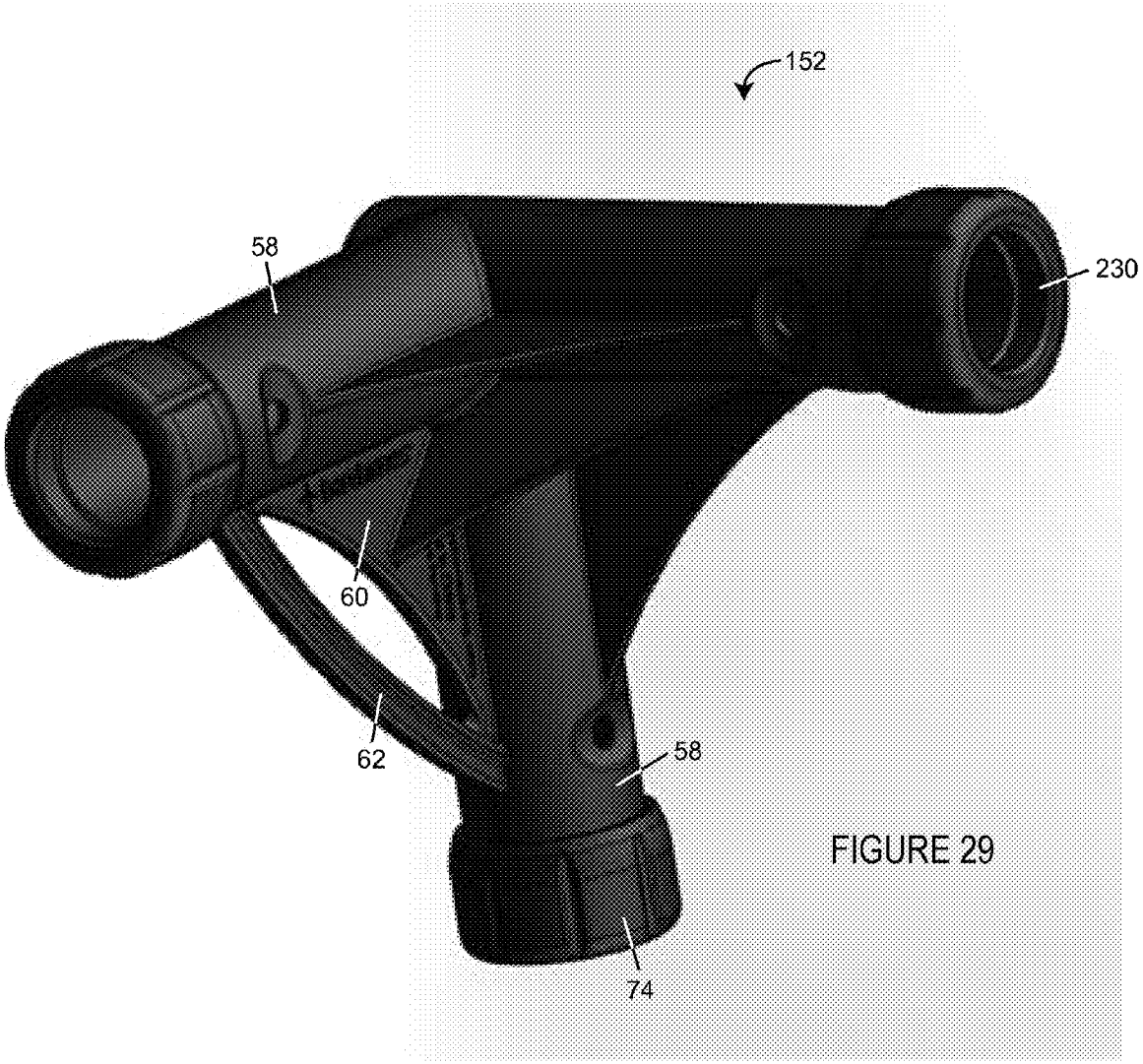
FIG. 29 is a perspective view of a three-point connector for a modular frame structure, according to an exemplary embodiment.
Figure 30:
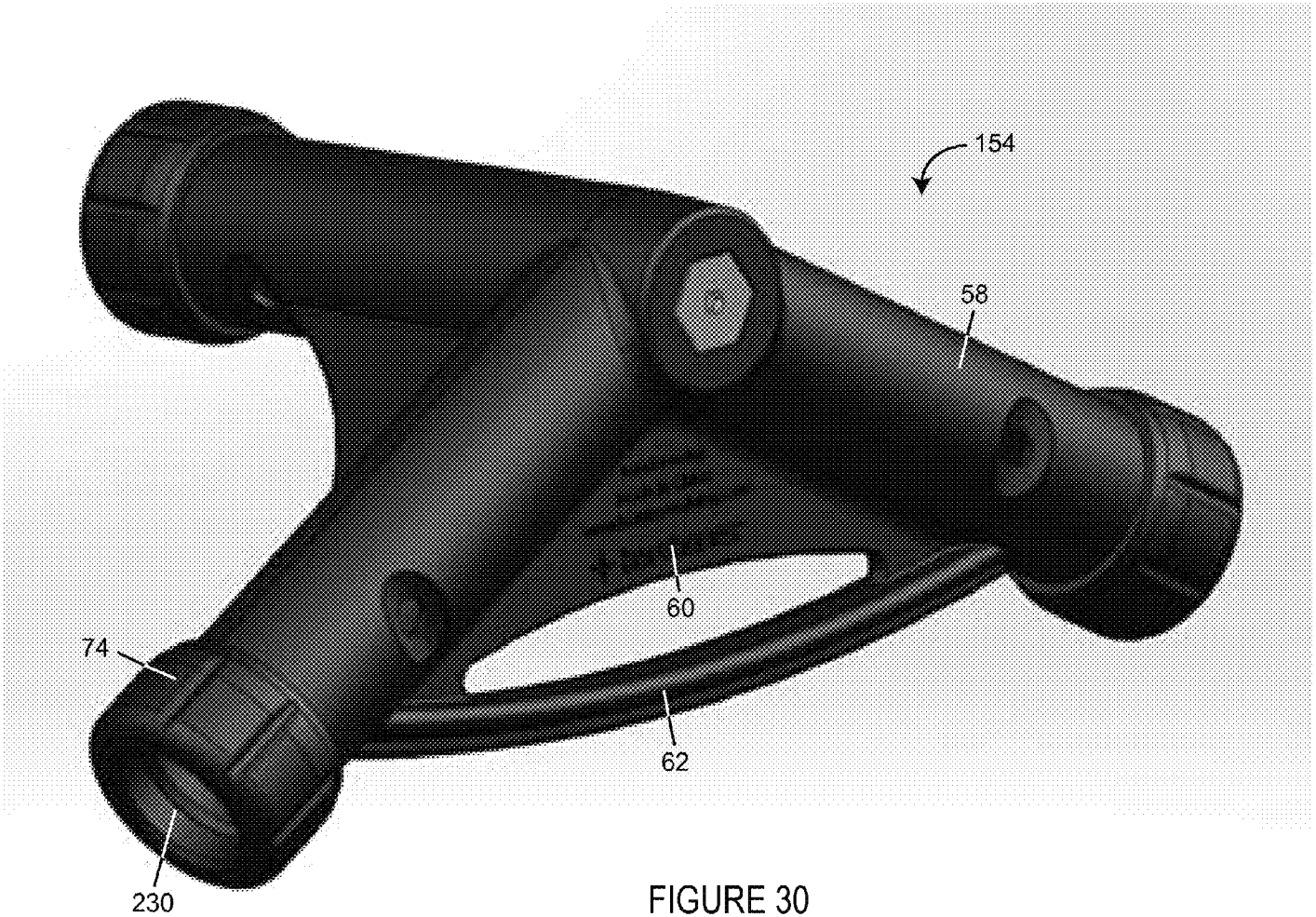
FIG. 30 is a perspective view of another three-point connector for a modular frame structure, according to an exemplary embodiment.
Figure 31:
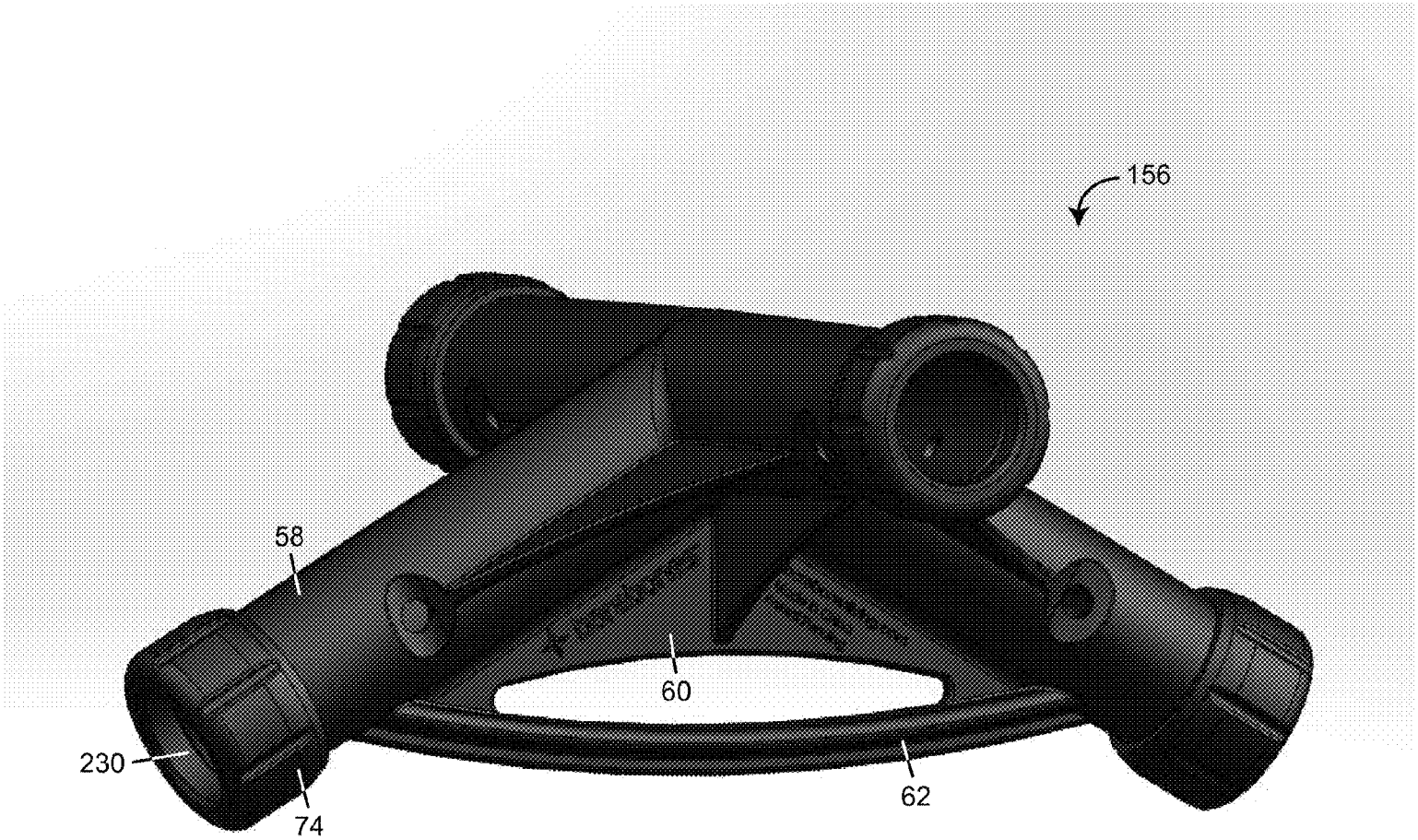
FIG. 31 is a perspective view of another four-point connector for a modular frame structure, according to an exemplary embodiment.

Referring to FIG. 24, a system 300 is shown having another cover configuration for use with the framework 20, according to another exemplary embodiment. In this embodiment, the wall panels 22 and/or roof panels 32 may include other features, such as built-in and selectively deployable flaps 50 (such as canopies, awnings, etc.), or such panels 22 or 32 may be releasably attached with quick-connect fasteners (not shown) to provide further flexibility in providing customizable structures suitable for use in any of a wide variety of applications. The system 300 may also include strengthening panels 48 at stress-locations, such as corners, or other areas that engage the frame members 12 or connectors 14 of the framework 20.

Referring now to FIGS. 25-32, multiple frame members 12 may be coupled together at joints at various angles using multi-point coupling devices or connectors 14. The multi-point connectors 14 include a multitude of tubular sockets 58.

Gussets 60 (e.g., braces, supports, etc.) may be provided between the tubular sockets 58 to reinforce and strengthen the connector 14. The connector 14 may further include other features, such as a rib 62 or strut to facilitate the stringing of electrical cords or lines (e.g. from solar panels to energy storage devices such as batteries and the like, or to electrical appliances, etc.), or for routing hoses or tubing (e.g. water collection or distribution, or distribution of medical supplies, etc.), or the attachment of other items such as equipment (portable lights, appliances, medical apparatus, etc.) covers or any of a wide variety of other components (e.g., using a carabiner or other suitable connector, as described below).

The frame members 12 are connected to the multi-point connectors 14 in a manner similar to the coupling system described above in reference to the in-line couplers 16. A wide variety of multi-point connector 14 configurations are possible to facilitate the creation of trusses and other structures for the modular frame and structure system 10. For example, connectors may be utilized for two, three, or four coplanar frame members that are oriented orthogonally by two-point connector 140, a three-point connector, and four-point connector 144, respectively (see FIGS. 25-26); for three, four, five or six frame members that are oriented orthogonally on multiple planes by six-point connector 146, five-point connector 148, a four-point connector, and three-point connector 152, respectively (see FIGS. 27-29), or for frame members that oriented at some other angle relative to each other (e.g., approximately 90 and 120 degrees) by three-point connector 154 or four-point connector 156 (see FIGS. 30-32). The advantageous features of these connectors 14 can be provided to support interconnection of frame members 12 in any of a wide variety of angles and configurations to support a particular application. Further, using short length couplers 16, multiple connectors 14 may be joined together to provide further capability to support customized coupling configuration requirements for a wide variety of applications.

Referring again to FIG. 32, a connector 14 is shown disassembled according to an exemplary embodiment, which is intended to provide the capability of allowing an 'interior' connector 14 to be decoupled from neighboring frame members 12 without having to substantially disassemble the framework 20 (e.g., disassembling other frame members and connectors from the accessible outside of the framework towards the inside). As shown, the connector 14 is split into two body halves 64 and 66 along a split line 68 that is aligned with at least one of the sockets 58. In other embodiments, the connector body 14 may have multiple split lines and separate into three or more portions.

The two halves 64 and 66 of the connector body 14 may be held together with suitable connectors, such as (but not limited to) a threaded fastener 70. As shown in FIG. 55, the threaded fastener 70 may be received in an opening in one of the sockets 58 that is not split. The threaded fastener 70 may engage a threaded hole in the connector body 14 or may pass through a hole to engage a threaded post or another suitable fastener, such as a nut. In other embodiments, the threaded fastener 70 may be provided elsewhere, such as on a flange or other portion of the connector body 14 outside of the socket 58. In further embodiments, the portions of the connector body 14 may be releasably joined together using other devices, such as by use of collars 74 or slip-rings disposed around the ends of the receptacles 230 for the frame members 12. While the receptacles 230 have been shown as circular or cylindrical receptacles 230 for receiving mating cylindrical poles such as frame members 12, the receptacles 230 and collars 74 may have any suitable shape to receive poles such as frame members 12 or other support members having a desired shape for a particular application.

Figure 32:
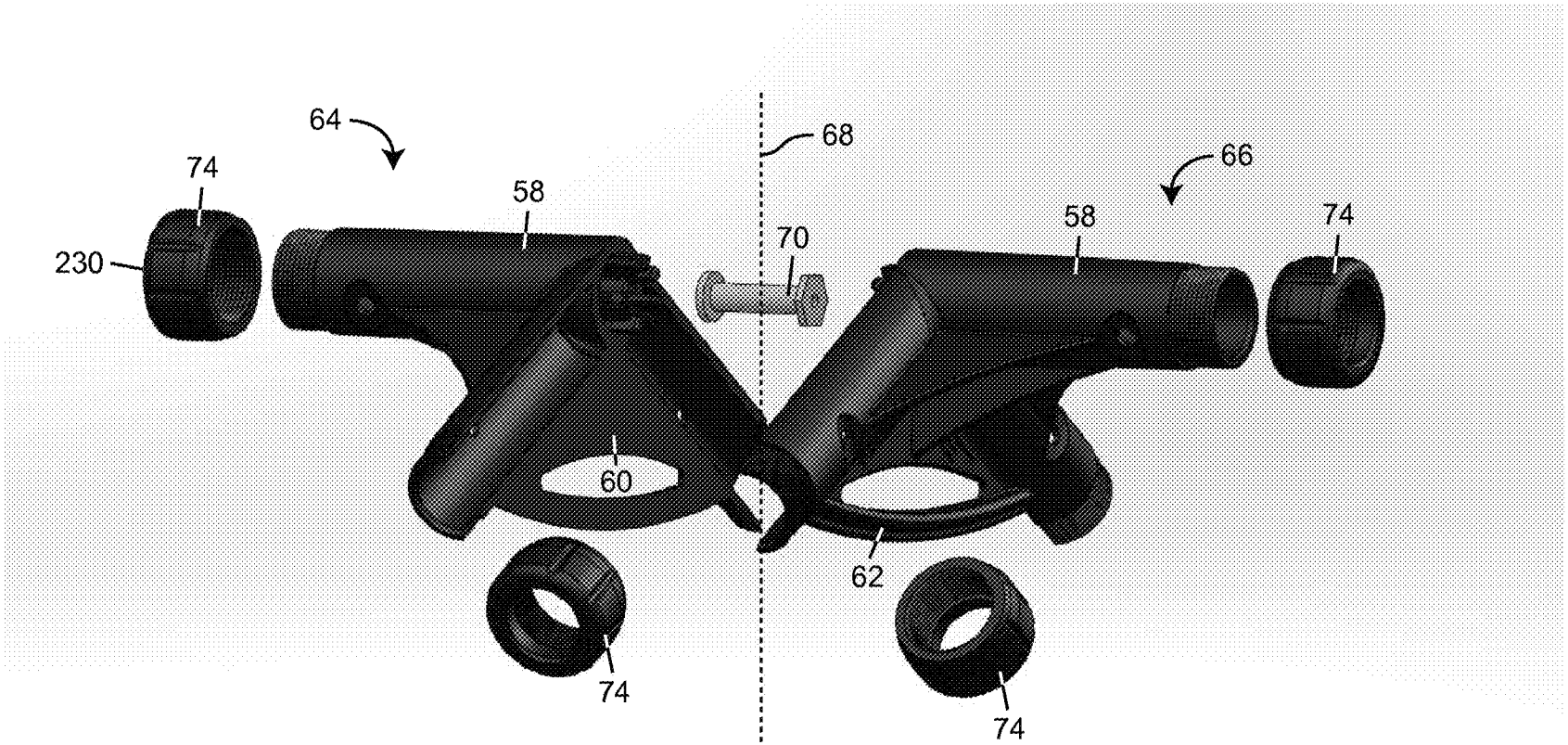
FIG. 32 is an exploded perspective view of the four-point connector of FIG. 31.

Referring still to FIG. 32, collars 74 (e.g., rings, sleeves, etc.) may be provided to further couple the connector body halves 64 and 66 together. Collars 74 surround the distal ends of the receptacles 230 on the split sockets 58 to prevent the sockets 58 from splitting apart inadvertently (e.g., because of a bending moment applied to the socket by the frame member) and to structurally reinforce the mouth of the receptacle 230. Collars 74 may also be provided for the non-split sockets 58 to reinforce the sockets 58. The collars 74 are configured to be quickly and easily removable, such as by an interference type slip-fit. In one exemplary embodiment, the collars 74 are coupled to connector body receptacle halves with a threaded connection. In other embodiments, the collars 74 may be coupled to the connector body receptacle halves with a snap fit or may be coupled to the connector body halves with an interference fit or another suitable connection, such as with a bayonet connection.

The frame member 12 received in the split socket 58 of a connector 14 may be removed by moving the frame member 12 perpendicular to the longitudinal axis of the frame member 12 instead of along the longitudinal axis. The connectors 14 may be disassembled by removing the collars 74 from the sockets 58 along the split line 68 and removing the threaded fasteners 70 (if any). The connector body halves 64 and 66 may then be separated along the split line 68 by disengaging any integrally formed coupling features, such as tabs on the ribs 62. In this way, the portions of the connector body 14 may be decoupled and need only be pulled away from each other until a sufficient clearance is created between the portions of the connector 14 to allow the frame member 12 to pass through. According to an exemplary embodiment, the frame members 12 are removed by rotating the free end (i.e., the end normally coupled to the split connector) about the opposite fixed end until the free end is moved out of the gap between the connector body halves 64 and 66 and is clear of the connector 14. This action is intended to apply less stress to the surrounding components of the framework 20 than otherwise attempting to pull the frame member 12 out along the longitudinal axis.

Figure 33:
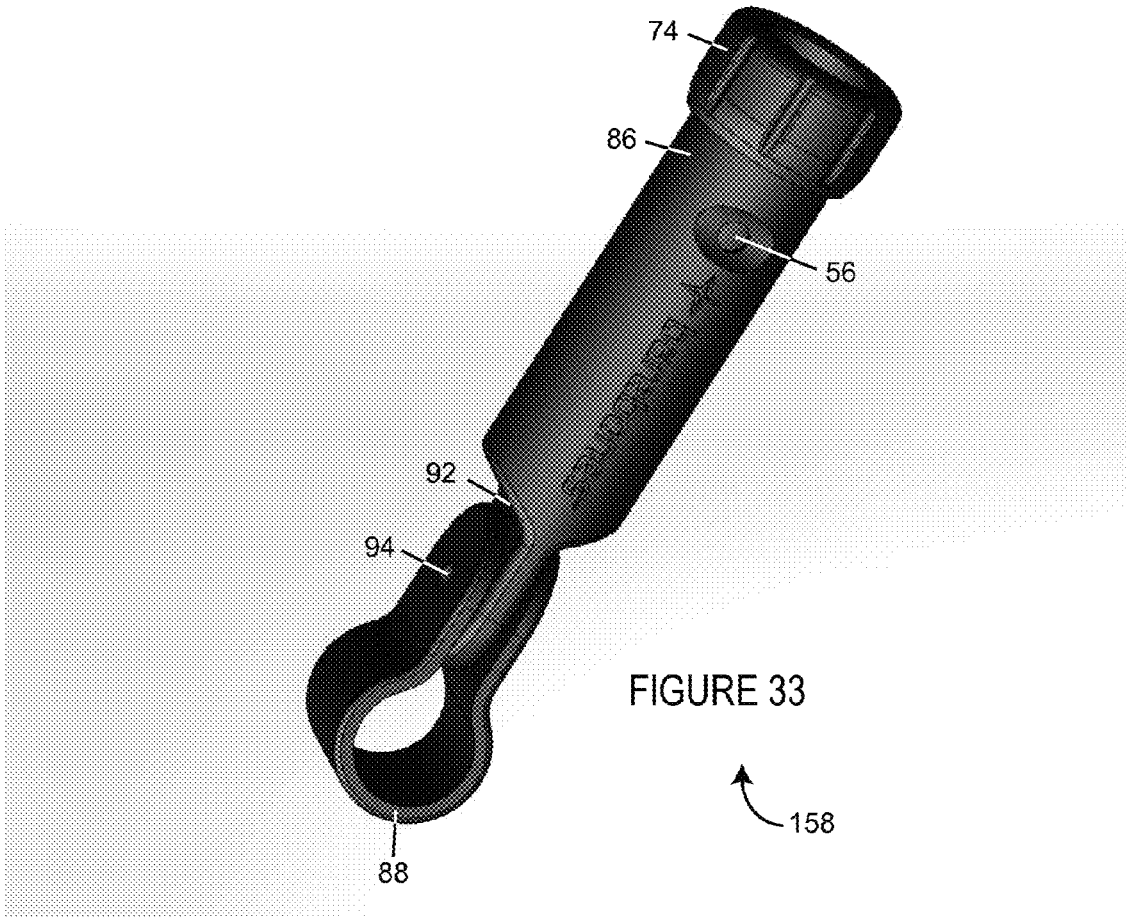
FIG. 33 is a perspective view of a hinged connector for a modular frame structure, according to an exemplary embodiment.

Other connectors 14 may be provided to increase the functionality and design flexibility of the modular frame and structure system 10. Referring to FIG. 33, hinged connector 158 (e.g., corner clamp connectors) is shown. Hinged connector 158 allows a frame member 12 to be coupled to another frame member 12 at any angle (in the manner of a brace, strut, support or the like). The hinged connector 158 includes a first end 86 that is coupled to the end of a frame member 12 in a removable manner. The first end 86 may be similar to the in-line coupler 16 and the multi-point connectors 14 described above and have an aperture 56 for a coupling device 52 such as a spring-loaded pin and a reinforcing collar 74 or 256. A second end 88 of the hinged connector 158 includes a cylindrical clamp 90 that is pivotably coupled to the first end at a hinge 92 with a removable fastener 94. The second end 88 may be snapped onto a frame member 12 and coupled to the first end 86 with the fastener 94 or the hinged connector 158 may first be assembled and then the second end 88 slipped onto the end of a frame member 12. A frame member 12 (or several frame members coupled together with in-line connectors or multi-point connectors) with hinged connector 158 on either end may be utilized as an angled brace to strengthen and add rigidity to the framework 20, as shown in FIG. 1.

Figure 34:
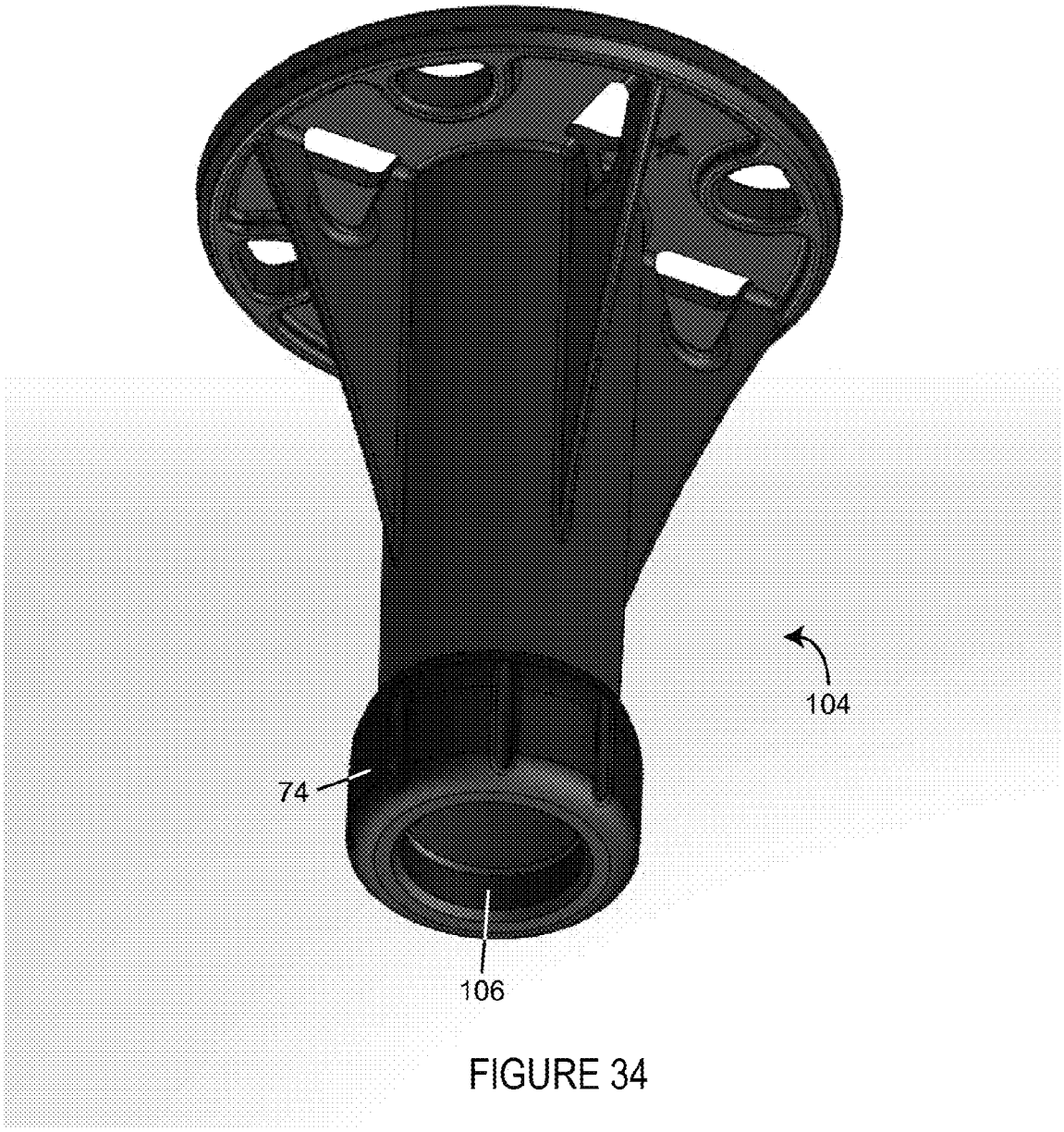
FIG. 34 is a perspective view of a foot for a modular frame structure, according to an exemplary embodiment.

Referring to FIG. 34, a vertical frame member 12 may be coupled to a foot 104 in a removable manner. The foot 104 may be similar to the in-line coupler 16 and the multi-point connectors 14 described above and have an aperture for a coupling device 52 such as a spring-loaded pin and a reinforcing collar 74. The foot 104 may be used as a generally horizontal base for a vertically-oriented frame member 12, or may be coupled to a generally vertical surface and used as a support for a generally horizontally-oriented frame member 12. Although the foot 104 is shown having a receptacle 106 extending substantially perpendicular to the base, the receptacle 106 may extend at any of a wide variety of angles, such as 60 degrees, 45 degrees, etc. to suit the needs of any particular installation.

Figure 35:
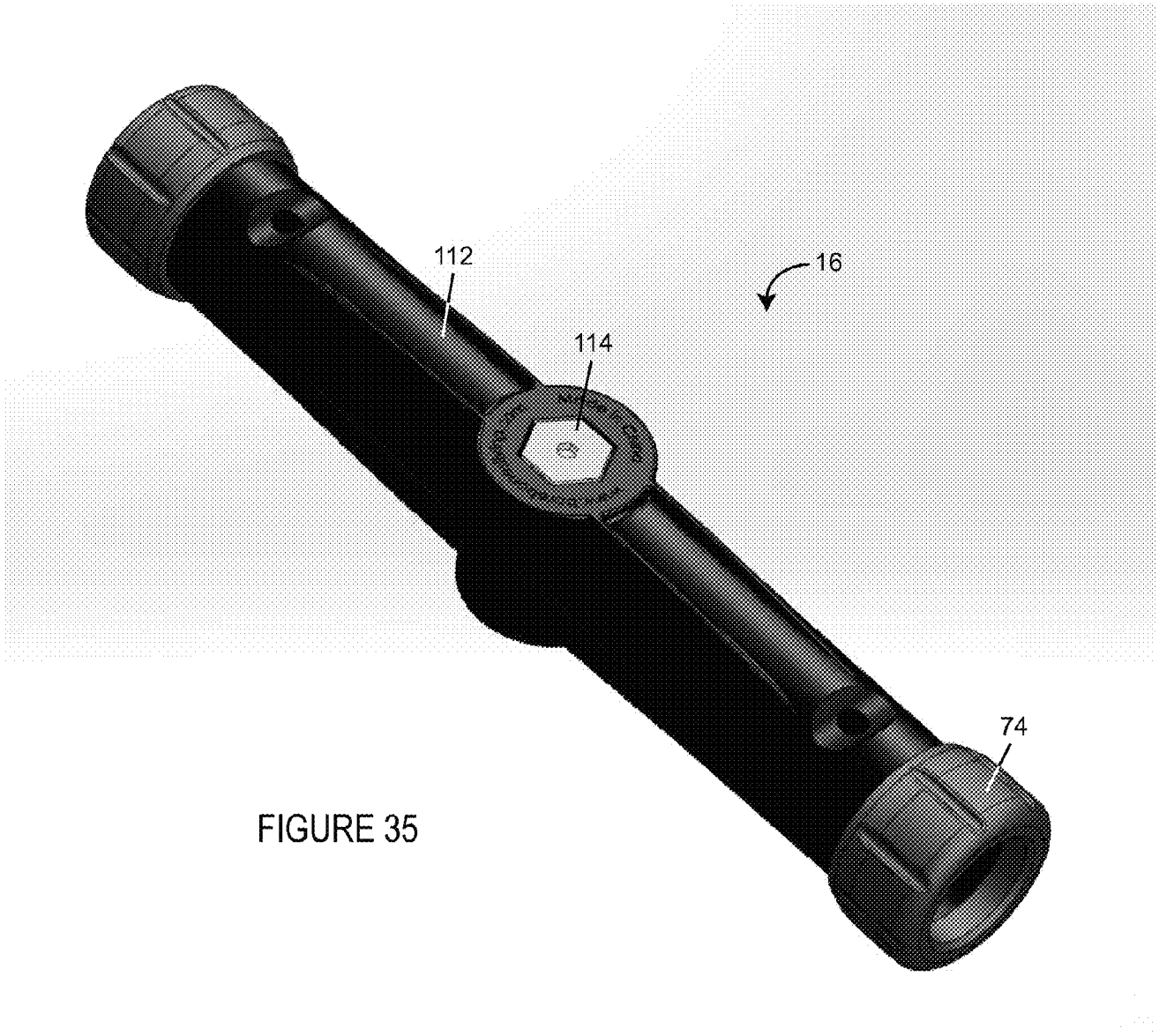
FIG. 35 is a perspective view of a two-point linear coupler for a frame member, according to an exemplary embodiment.

Referring to FIG. 35, in-line coupler 16 is shown, according to exemplary embodiments. In-line couplers 16 may be used to couple two frame members 12 of the framework 20. In this embodiment, the in-line coupler 16 is separable into more than one portion and may be coupled together with a fastener 114. In other embodiments, the in-line coupler 16 may be a single piece. The frame members 12 are inserted through the collars 74 of the in-line coupler 16. The in-line coupler 16 is configured to separate at a split line 112.

Figure 36:
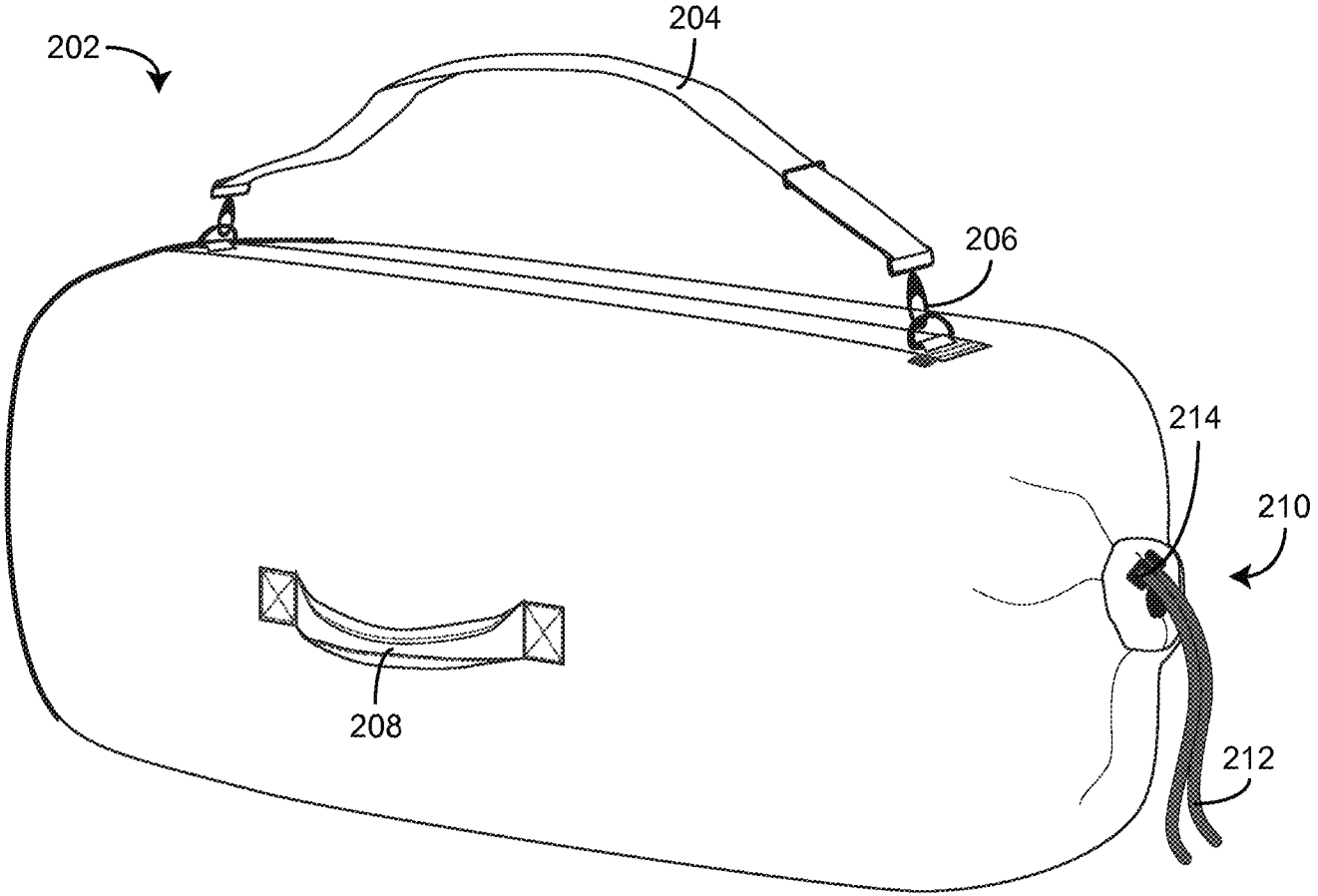
FIG. 36 is a perspective view of a storage bag for the modular frame and structure system of the present disclosure, according to an exemplary embodiment.
Figure 38:
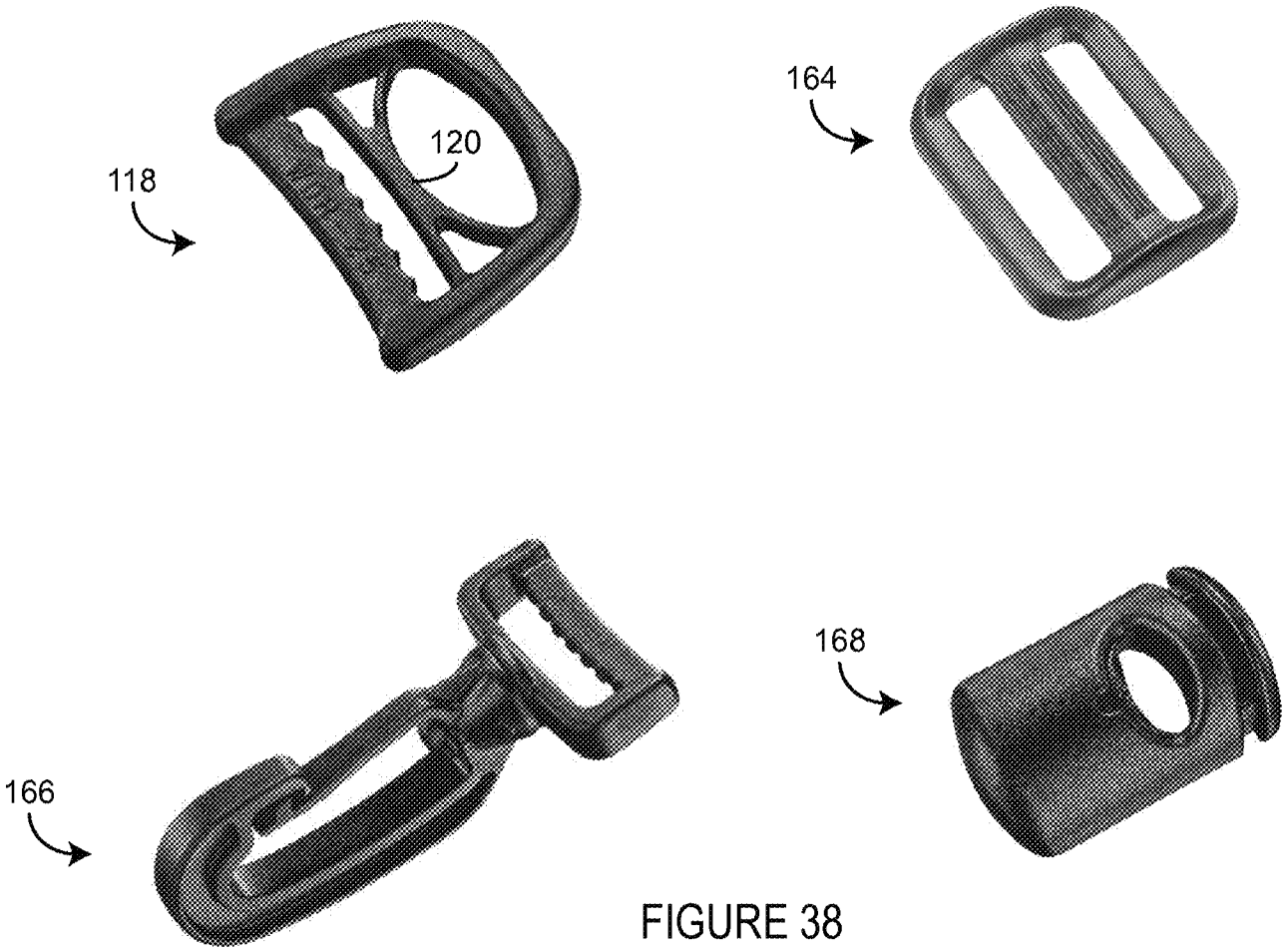
FIG. 38 is a perspective view of connecting hardware for a modular frame and structure system.

Referring to FIG. 36, a storage bag for the modular frame and structure system 10 is shown, according to an exemplary embodiment. The storage bag 202 is sized to hold the components of the framework 20, including the frame members 12 and multi-point connectors 14. The storage bag 202 may be made from the same materials as the wall panels 22, or any other materials including fabric materials, such as a rip-stop nylon material or the like. The storage bag 202 may include a shoulder strap 204 for carrying the portable storage bag 202. The shoulder strap 204 may be coupled to the storage bag 202 with any type of clip hardware 206. Some examples of clip hardware 206 are shown in FIG. 38. The storage bag 202 may also include a handle 208 for carrying the storage bag 202. The handle 208 is made from the same material as the bag 202 in exemplary embodiments. The storage bag 202 also includes an opening 210 that is closed by a nylon accessory cord 212. When the cord 212 is pulled away from the opening 210, the storage bag 202 is cinched at the opening 210, closing the storage bag 202. The storage bag 202 includes a cord lock 214 for locking the cord 212 and holding the opening 210 in the closed position. According to one embodiment, after deployment of the components from storage bag to create a structure, the storage bag may then be attached to the structure using any one of the previously described connecting devices to provide a storage compartment internal or external to the structure.

Figure 37:
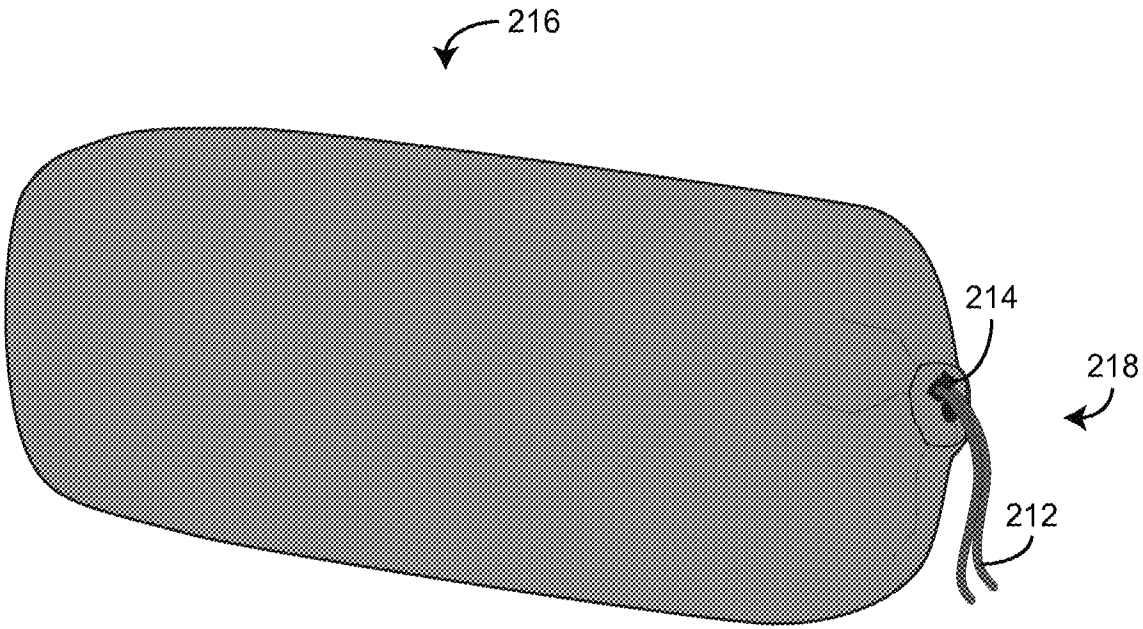
FIG. 37 is a perspective view of an inner storage bag for the modular frame structure of the present disclosure, according to an exemplary embodiment.

Referring to FIG. 37, an inner bag 216 is shown, according to an exemplary embodiment. The inner bag 216 is configured to store poles, such as the frame members 12. The inner bag 216 includes an opening 218 that is closed by pulling nylon cord 212 away from the opening 218. The cord 212 and opening 218 are then locked in the closed position by a cord lock such as cord lock 214. The inner bag 216 is sized to fit within the storage bag 202, in exemplary embodiments.

Referring to the FIGURES, the modular frame and structure system is configured to be quickly and securely assembled and disassembled using common coupling features (e.g., spring-loaded coupling pins). Further, the connectors for the modular frame and structure system include common parts between them, such as common threaded fasteners and collars. Still further, the connectors themselves may include common geometries along the split line. For example, the five-point connector 148 of FIG. 28 may be constructed with one half of the six-point connector 146 of FIG. 27 and one half of a four-point connector (not shown). Accordingly, all such variations are intended to be within the scope of this disclosure.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the subject matter as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is also important to note that the construction and arrangement of the modular frame and structure system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present disclosure as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the disclosure.

What is claimed is:

1. A modular frame and structure system, comprising:

a framework, comprising:

a plurality of elongated frame members; and a plurality of coupling members for coupling the elongated frame members;

wherein each of the plurality of coupling members are configured to be releasably interconnected to at least one of the plurality of elongate frame members with a releasable connecting device having a connecting mode for connecting the coupling members to the frame members and form the framework, the releasable connecting device having a release mode for disconnecting the elongated frame members from the coupling members;

a cover coupled to the framework and configured to provide a desired structure, the cover comprising:

one or more wall panels configured to engage and be supported by the elongated frame members;

one or more roof panels configured to engage and be supported by the elongated frame members; and one or more floor panels forming a floor surface, the one or more floor panels comprising one or more upwardly extending flaps configured to couple to an inside surface of the interlocking wall panels, thereby providing a seal between the one or more floor panels and the one or more wall panels.

2. The system of claim 1, wherein the coupling members comprise a first portion and a second portion that are connectable to one another by engaging the releasable connecting device in the connecting mode, and are separable from one another by disengaging the releasable connecting device in the release mode.

3. The system of claim 2, wherein the releasable connecting device comprises at least one of a threaded fastener and interlocking projections.

4. The system of claim 2, wherein the releasable connecting device comprises one or more removable sleeves that substantially surround at least a portion of the first and second portions of the coupling member.

5. The system of claim 1, further comprising one or more straps coupled to the wall panels and one or more straps coupled to the roof panels, the straps coupling the wall panels and roof panels to the elongated frame members.

6. The system of claim 1, wherein the wall panels comprise one or more windows having a first panel and a second panel, the first panel having a deployed position and a storage position and covering the second panel in the deployed position, the second panel having a mesh portion configured to allow air into the system.

7. The system of claim 6, wherein the first panel is configured to roll into the storage position generally above the second panel, the first panel being secured by one or more straps in the storage position.

8. The system of claim 1, wherein the roof panels are substantially transparent and configured to admit sunlight and prevent heat escape via convection.

9. The system of claim 2, wherein the first and second portions of the coupling members mate with one another to form one or more sockets configured to receive the elongated frame members, and further comprising one or more collars configured to surround and reinforce the sockets having the elongated frame members therein.

10. A modular frame and structure system, comprising:

a framework comprising four interconnected side walls and an interconnected pitched roof, the framework comprised of:

a plurality of elongated frame members; and a plurality of coupling members for coupling the elongated frame members together, the plurality of coupling members comprising 2-point connectors, 3-point corner connectors, 3-point T connectors, 3-point roof connectors and 4-point roof connectors;

wherein the 3-point corner connectors, 3-point T connectors and a first set of 2-point connectors are coupled together with associated elongate frame members of the plurality of elongated frame members to form the four interconnected side walls; and wherein the 3-point roof connectors, 4-point roof connectors and a second set of 2-point connectors are coupled together with associated elongate frame members of the plurality of elongated frame members to form the pitched roof frame;

a fabric cover comprising four side walls and a roof coupled to an exterior of and supported by the framework, a fabric floor forming a floor surface between the four side walls, the fabric floor comprising a plurality of upwardly extending flaps releasably coupled to an inside surface of the interlocking wall panels providing a seal between the fabric floor and the inside surface of the one or more wall panels.

11. The modular frame and structure system of claim 10, further comprising a plurality of lower flaps, each depending and laterally extending from a lower edge of a respective side wall.

12. The modular frame and structure system of claim 10, wherein the framework is disposed on an interior surface of the fabric cover so that the framework is exposed to an interior of the structure.

13. The modular frame and structure system of claim 10, wherein each of the 3-point corner connectors, 3-point T connectors, 3-point roof connectors and 4-point roof connectors comprise a strut extending between two connection points for supporting other structures relative thereto.

14. A shelter, comprising:

a plurality of elongate frame members;

a plurality of coupling members coupling the elongate frame members together, the plurality of coupling members and plurality of elongate frame members forming an interior frame structure having a plurality of side walls and a roof;

a fabric cover comprising a plurality of interconnected side walls and a roof coupled to an exterior of the interior frame structure and supported by the interior frame structure;

a plurality of lower flaps, each depending and laterally extending from a lower edge of each of the plurality of interconnected side walls; and a fabric floor forming a floor surface between the plurality of side walls, the fabric floor comprising a plurality of upwardly extending flaps releasably coupled to an inside surface of the plurality of interconnected side walls providing a seal between fabric floor and the inside surface of the one or more wall panels.

15. The shelter of claim 14, wherein the plurality of coupling members comprise 2-point connectors, 3-point corner connectors, 3-point T connectors, 3-point roof connectors and 4-point roof connectors.

16. The shelter of claim 15, wherein the 3-point corner connectors, 3-point T connectors and a first set of 2-point connectors are coupled together with associated elongate frame members of the plurality of elongated frame members to form the plurality of interconnected side walls.

17. The shelter of claim 16, wherein the 3-point roof connectors, 4-point roof connectors and a second set of 2-point connectors are coupled together with associated elongate frame members of the plurality of elongated frame members to form the roof.

18. The shelter of claim 15, wherein each of the 3-point corner connectors, 3-point T connectors, 3-point roof connectors and 4-point roof connectors comprise a strut extending between two connection points for supporting other structures relative thereto.

* * * * *